US011408413B2

(12) United States Patent
Jeon et al.

(10) Patent No.: US 11,408,413 B2
(45) Date of Patent: Aug. 9, 2022

(54) LINEAR COMPRESSOR

(71) Applicant: LG Electronics Inc., Seoul (KR)

(72) Inventors: Gyeoungjin Jeon, Seoul (KR); Hangjun Cho, Seoul (KR); Jonghun Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 74 days.

(21) Appl. No.: 16/780,564

(22) Filed: Feb. 3, 2020

(65) Prior Publication Data

US 2021/0003122 A1 Jan. 7, 2021

(30) Foreign Application Priority Data

Jul. 5, 2019 (KR) ..... 10-2019-0081611

(51) Int. Cl.

| | |
|---|---|
| ***F04B 39/12*** | (2006.01) |
| ***F04B 53/00*** | (2006.01) |
| ***F04B 39/00*** | (2006.01) |
| ***F25B 31/02*** | (2006.01) |
| ***F25B 1/02*** | (2006.01) |
| ***F04B 35/04*** | (2006.01) |

(52) U.S. Cl.

CPC ..... *F04B 39/127* (2013.01); *F04B 35/045* (2013.01); *F04B 39/0044* (2013.01); *F04B 39/121* (2013.01); *F04B 53/003* (2013.01); *F25B 1/02* (2013.01); *F25B 31/023* (2013.01); *F25B 2309/001* (2013.01); *F25B 2400/073* (2013.01)

(58) Field of Classification Search

CPC .... F25B 1/02; F25B 31/023; F25B 2400/073; F25B 2309/001; F04B 39/127; F04B 39/0044; F04B 53/003; F04B 35/04; F04B 35/045

See application file for complete search history.

(56) References Cited

U.S. PATENT DOCUMENTS 3,250,461 A * 5/1966 Parker ..... F25B 31/023 417/312
3,531,069 A * 9/1970 Dubberley ..... F16F 15/067 248/565

(Continued)

FOREIGN PATENT DOCUMENTS

EP 2719896 4/2014
EP 3244064 11/2017

(Continued)

OTHER PUBLICATIONS

Korean Office Action in Korean Appln. No. 10-2019-0013179, dated Apr. 24, 2020, 129 pages (with English translation).

(Continued)

*Primary Examiner* — Christopher S Bobish
(74) *Attorney, Agent, or Firm* — Fish & Richardson P.C.

(57) ABSTRACT

Provided is a linear compressor. The linear compressor includes a shell, a compressor body disposed in the shell, and a first support device coupled to a front portion of the compressor body in an axial direction to support the compressor body. The first support device may be disposed between an inner circumferential surface of the shell and the compressor body to support the compressor body in a radial direction.

16 Claims, 24 Drawing Sheets

(56) References Cited

U.S. PATENT DOCUMENTS

| | | | | |
|---|---|---|---|---|
| 4,416,594 | A * | 11/1983 | Ichikawa | F04B 39/127 248/606 |
| 5,772,410 | A * | 6/1998 | Chang | F04B 35/045 417/363 |
| 6,729,861 | B2 * | 5/2004 | Oh | F04B 35/045 417/417 |
| 6,832,899 | B2 * | 12/2004 | Puff | F16F 7/104 417/363 |
| 8,678,788 | B2 * | 3/2014 | Kim | F04B 39/122 417/417 |
| 9,995,294 | B2 * | 6/2018 | Miguel | F04B 39/0027 |
| 10,400,757 | B2 * | 9/2019 | Jeon | F04B 39/0044 |
| 2005/0201875 | A1 * | 9/2005 | Park | F04B 35/045 417/417 |
| 2006/0153712 | A1 * | 7/2006 | Park | F04B 39/0044 417/417 |
| 2006/0251529 | A1 * | 11/2006 | Kim | F04B 35/045 417/417 |
| 2010/0133733 | A1 * | 6/2010 | Cappeller | F16F 1/025 267/140.5 |
| 2015/0184651 | A1 * | 7/2015 | Ki | F04B 53/145 417/349 |
| 2016/0017877 | A1 * | 1/2016 | Ki | F04B 39/127 417/437 |
| 2016/0017878 | A1 * | 1/2016 | Kim | F04B 39/126 417/437 |
| 2017/0321674 | A1 * | 11/2017 | Ha | F04B 19/22 |

FOREIGN PATENT DOCUMENTS

| | | |
|---|---|---|
| EP | 3438453 | 2/2019 |
| KR | 20160024217 | 3/2016 |
| KR | 20180040791 | 4/2018 |
| KR | 10-2018-0084414 | 7/2018 |
| KR | 10-2019-0013179 | 2/2019 |

OTHER PUBLICATIONS

Extended European Search Report in European Appln. No. 20155436.7, dated Jul. 2, 2020, 7 pages.

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2019-0081611 filed on Jul. 5, 2019, which is hereby incorporated by reference in its entirety.

BACKGROUND

The present disclosure relates to a linear compressor.

In general, compressors are machines that receive power from a power generation device such as an electric motor or a turbine to compress, a refrigerant, or various working gases, thereby increasing a pressure. Compressors are being widely used in home appliances or industrial fields.

Compressors are largely classified into reciprocating compressors, rotary compressors, and scroll compressors.

In such a reciprocating compressor, a compression space, in which a working gas is suctioned or discharged, is provided between a portion and a cylinder so that a refrigerant is compressed while the piston linearly reciprocates within the cylinder.

In addition, in such a rotary compressor, a compression space, in which a working gas is suctioned or discharged, is provided between a roller that rotates eccentrically and a cylinder so that a refrigerant is compressed while the roller rotates eccentrically along an inner wall of the cylinder.

In addition, in such a scroll compressor, a compression space, in which a working gas is suctioned and discharged, is provided between an orbiting scroll and a fixed scroll so that a refrigerant is compressed while the orbiting scroll rotates along the fixed scroll.

In recent years, a linear compressor, in which a piston is directly connected to a driving motor that linearly reciprocates, among the reciprocating compressors has been developed. The linear compressor has a simple structure that is capable of improving compression efficiency without mechanical loss due to motion switching.

In the linear compressor, a compressor body including the piston and the driving motor (linear motor) within the sealed shell. Also, the piston linearly reciprocates by the driving motor. As the piston linearly reciprocates, a refrigerant is suctioned and compressed to be discharged.

Here, the compressor body may vibrate by the linear reciprocation of the piston as described above. Also, to prevent the vibration from being transmitted to the outside of the shell, a structure (hereinafter, a support device) that spaces the compressor body from the shell to support the compressor body is provided in the linear compressor.

Regarding the support structure of the linear compressor, the present applicant has filed and published the following prior art document (hereinafter referred to as a first prior art document).

1. Patent Publication Number: 10-2018-0040791 (Date of Publication: Apr. 23, 2018)

2. Tile of the Invention: LINEAR COMPRESSOR

The first prior art document discloses a linear compressor having a shell provided in a cylindrical shape and a compressor body disposed inside a shell. Particularly, the shell extends in an axial direction parallel to a bottom surface.

Also, a support device supporting the compressor body on an inner surface of the shell is disclosed. In detail, the support device is disposed on each of both sides of the compressor body in the axial direction to support the compressor body within the shell. This is done for reducing the vibration of the compressor body by a driving unit such as the piston reciprocating linearly in the axial direction.

The first prior art document discloses a support device for supporting the compressor body in the axial direction. Here, the compressor body is disposed spaced apart from the shell not only in the axial direction but also in a radial direction perpendicular to the axial direction. However, the prior art has a limitation that a device supporting the compressor body in the radial direction is not disclosed.

Also, since the shell extends in the axial direction parallel to the bottom surface, the compressor body may droop to the bottom surface by its own weight. However, the prior art has a limitation that is the support device considering the drooping of the compressor body by its own weight is not disclosed.

Particularly, when the compressor body is driven in the state of drooping to the bottom surface by its own weight, there is a limitation that the drive unit including the piston reciprocates away from a central axis. Thus, there is a limitation that a flow of the refrigerant is not effectively generated, and possibility of breakage of the mechanism is high.

In order to solve the limitation, in connection with the support structure of the linear compressor that radially supports the compressor body, the present applicant has filed and published the following prior art document (hereinafter referred to as a second prior art document).

1. Patent Publication Number: 10-2019-0013179 (Date of Publication: Feb. 11, 2019)

2. Tile of the Invention: LINEAR COMPRESSOR

The linear compressor according to the second prior art document includes a first support device supporting a front end of the compressor body and a second support device supporting a rear end of the compressor body. The first support device includes a support head coupled to a center of the front end of the compressor body and a pair of damping units connected at both ends to the support head and an inner circumferential surface of a shell.

The second prior art document discloses a support device supporting the compressor body in the radial direction. Particularly, the support device is disposed at a front side of the compressor body in an axial direction. Thus, there is a limitation in that a space in which the support device is disposed has to be provided separately in the shell.

Thus, there is a limitation that a size of the shell increases, and a volume of the entire compressor increases. Also, there are limitations in that a space in which the compressor is installed is limited, and installation efficiency of the compressor is reduced.

Also, the support device has a limitation in that a strong moment is applied to the support device because the support device extends relatively long to connect the compressor body to the shell. Thus, the support device has a limitation that it is difficult to stably support the compressor body.

SUMMARY

Embodiments provide a linear compressor including a support device supporting a compressor body within a shell in a radial direction.

Embodiments also provide a linear compressor including a support device disposed between a compressor body and a shell to improve space utilization and provided in a relatively small size.

Embodiments also provide a linear compressor in which a compressor body is more stably supported by a support device having a relatively small length between the compressor body and the shell.

A linear compressor according to an embodiment includes a first support device supporting a compressor body to a shell in a radial direction.

A first support device of a linear compressor according to first to third embodiments may be disposed at a front side of a compressor body in an axial direction to support the compressor body.

In detail, the first support device of the linear compressor according to the first embodiment may be coupled to a front center of the compressor body in the axial direction to extend outward in the radial direction. The first support device of the linear compressor according to the second to third embodiments may be coupled to a constituent disposed at a front side of the compressor body in the axial direction to extend outward in the radial direction.

A first support device of a linear compressor according to fourth to sixth embodiments may be disposed between a compressor body and a shell in a radial direction to support the compressor body.

In detail, the compressor body may include a discharge cover defining a discharge space in which a refrigerant is compressed to be discharged. The first support device may be disposed between the discharge cover and the shell so that the first support device is disposed outside the discharge space in the radial direction to support the compressor body.

In one embodiment, a linear compressor includes: a shell having a cylindrical shape that extends in an axial direction; a compressor body disposed within the shell; a first shell cover coupled to a rear end of the shell in the axial direction; a second shell cover coupled to a front end of the shell in the axial direction; a first support device coupled to a front portion of the compressor body in the axial direction to support the compressor body; and a second support device disposed between the compressor body and the first shell cover to support the compressor body in the axial direction.

The first support device may be disposed between an inner circumferential surface of the shell and the compressor body to support the compressor body in a radial direction.

In another embodiment, a linear compressor includes: a piston configured to reciprocate in an axial direction; a cylinder in which the piston is accommodated in the inside thereof in a radial direction; a frame in which the cylinder is accommodated in the inside thereof in the radial direction; a discharge cover coupled to the frame to define a discharge space through which a refrigerant compressed by the piston flows; a shell in which the cylinder, the frame, and the discharge cover are accommodated in the inside thereof in the radial direction; and a support device disposed between the discharge cover and the shell in the radial direction so as to be disposed outside the discharge space in the radial direction.

The details of one or more embodiments are set forth in the accompanying drawings and the description below. Other features will be apparent from the description and drawings, and from the claims.

DETAILED DESCRIPTION OF THE EMBODIMENTS

Figure 1A:
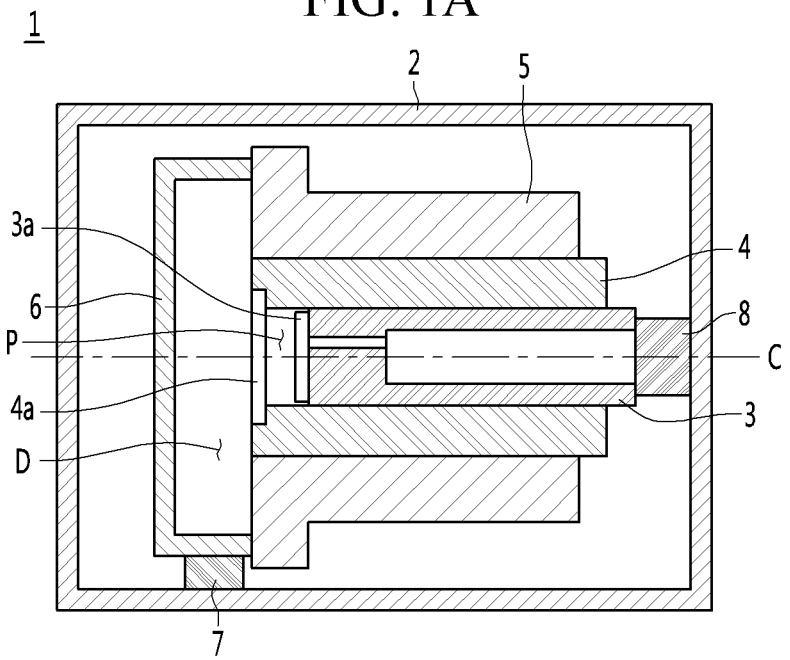
FIGS. 1A and 1B are schematic views illustrating a support structure of a linear compressor according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. In the following description of the present disclosure, a detailed description of known functions and configurations incorporated herein will be omitted to avoid making the subject matter of the present disclosure unclear.

In the description of the elements of the present disclosure, the terms first, second, A, B, (a), and (b) may be used.

Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 1B:
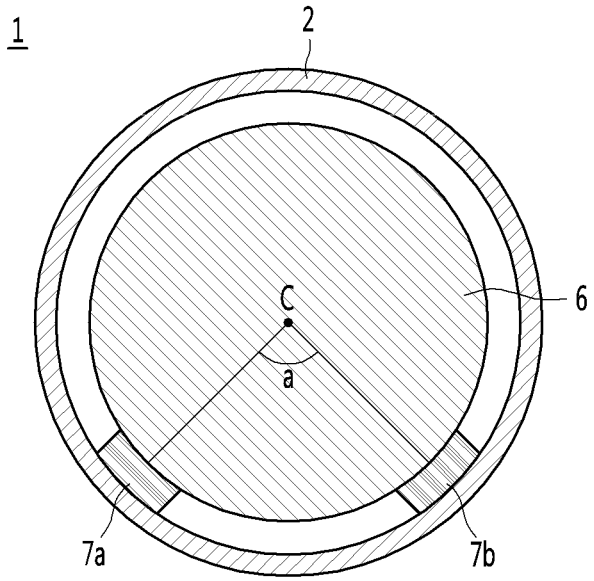

FIGS. 1A and 1B are schematic views illustrating a support structure of a linear compressor according to an embodiment.

Figure 2:
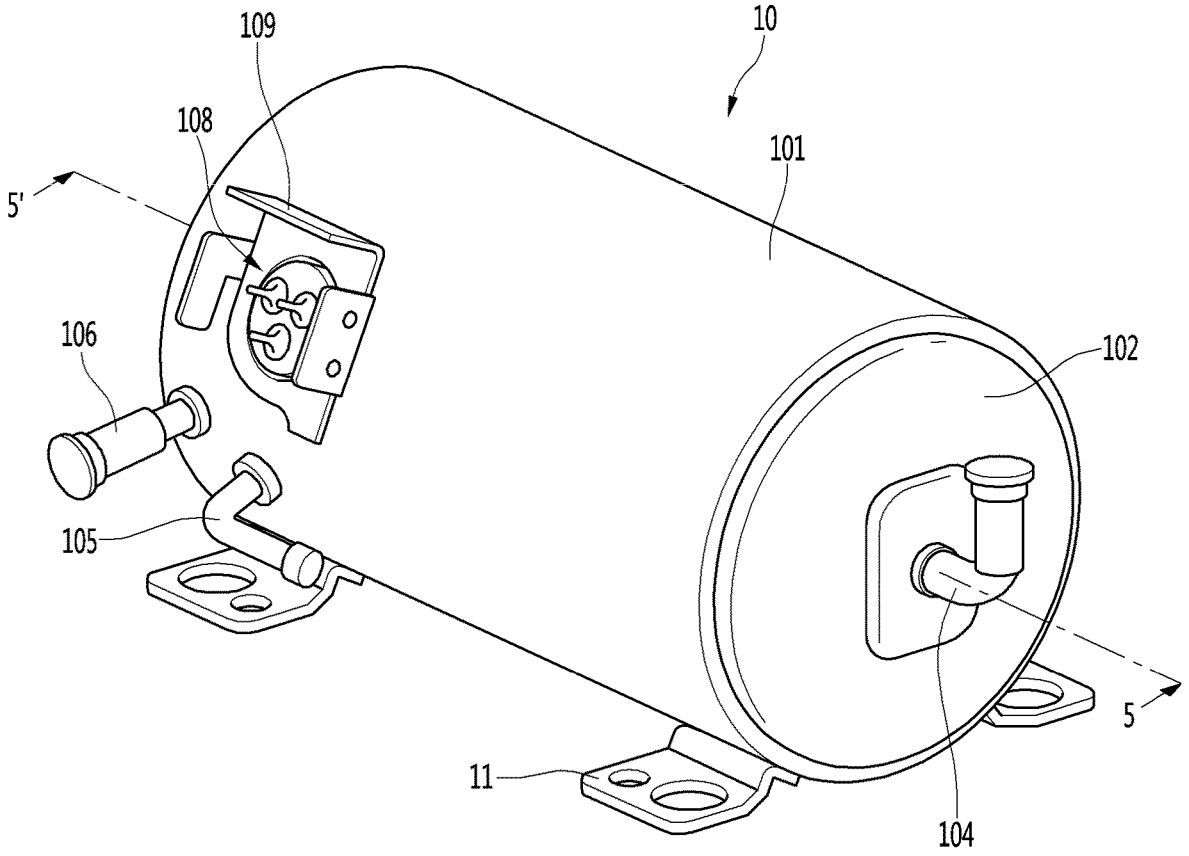
FIG. 2 is a view illustrating an outer appearance of a linear compressor according to a first embodiment.

Referring to FIGS. 1A, 1B, and 2, a linear compressor 1 according to an embodiment includes a shell 2 and a compressor body disposed inside the shell 2. Here, FIG. 1A is a longitudinal cross-sectional view of the linear compressor 1, and FIG. 1B is a transverse cross-sectional view of the linear compressor 1.

The shell 2 is provided in a cylindrical shape having an inner space. Thus, in FIG. 1A, the shell 2 has a rectangular frame shape, and in FIG. 1B, the shell 2 has a circular frame shape. Particularly, the shell 2 may extend parallel to a bottom surface.

The compressor body includes a piston 3, a cylinder 4, a frame 5, and a discharge cover 6. The cylinder 4 is disposed inside the frame 5, and the discharge cover 6 is coupled to one side of the frame 5. Also, the piston 3 is disposed inside the cylinder 4 so as to reciprocate.

Also, the piston 3 and the cylinder 4 define a compression space P through which a refrigerant is compressed by the reciprocating movement of the piston 3. In detail, the compression space P is defined between a suction valve 3*a* disposed at one side of the piston 3 and a discharge valve 3*b* disposed at one side of the cylinder 4.

Thus, the refrigerant flows into the compression space P as the suction valve 3*a* is opened, and then, the refrigerant is discharged from the compression space P as the discharge valve 3*b* is opened. Also, the refrigerant discharged from the compressed space P flows into a discharge space D defined inside the discharge cover 6.

Here, the compressor body vibrates by the reciprocating movement of the piston 3 to generate noise. To prevent such vibration and noise from being transmitted to the outside through the shell 2, the compressor body may be spaced apart from the shell 2.

In detail, the linear compressor 1 is provided with a support structure supporting the compressor body inside the shell 2. As illustrated in FIG. 1A, the support structure includes a first support device 7 and a second support device 8, which are arranged between the compressor body and the shell 2.

The first support device 7 may be understood as a device supporting the compressor body in a direction perpendicular to a direction of the reciprocating movement of the piston 3. On the other hand, the second support device 8 may be understood as a device supporting the compressor body in the direction of the reciprocating movement of the piston 3.

The direction of the reciprocating movement of the piston 3 is the same as the longitudinal direction of the shell 2. Also, this is called an axial direction, and a central axis C to which the piston 3 reciprocates and the central axis C of the shell 2 are the same. Also, the constituents provided in the compressor body are arranged based on the central axis C.

On the other hand, the direction perpendicular to the direction of the reciprocating movement of the piston 3 corresponds to the radial direction of the shell 2. This is called a radial direction. That is, the first support device 7 supports the compressor body in the radial direction, and the second support device 8 supports the compressor body in the axial direction.

Thus, the first support device 7 may be referred to as a radial support device, and the second support device 8 may be referred to as a shaft support device. Also, the first support device 7 is coupled to the discharge cover 6 and is installed at a side at which the refrigerant is discharged. Thus, the first support device 7 may be referred to as a discharge support device, and the second support device 8 may be referred to as a suction support device.

Also, as illustrated in FIG. 1B, the first support device 7 may be provided in plurality that are coupled to the discharge cover 6. Particularly, the first support device 7 may be provided in a pair that are spaced a preset angle a from each other with respect to the central axis C. Here, the preset angle a may be set to about 120 degrees.

Hereinafter, based on a specific structure of the linear compressor 1, various embodiments of the first support device 7 will be described. Each embodiment is described by using different reference numerals for the same configuration for the purpose of division.

Figure 3:
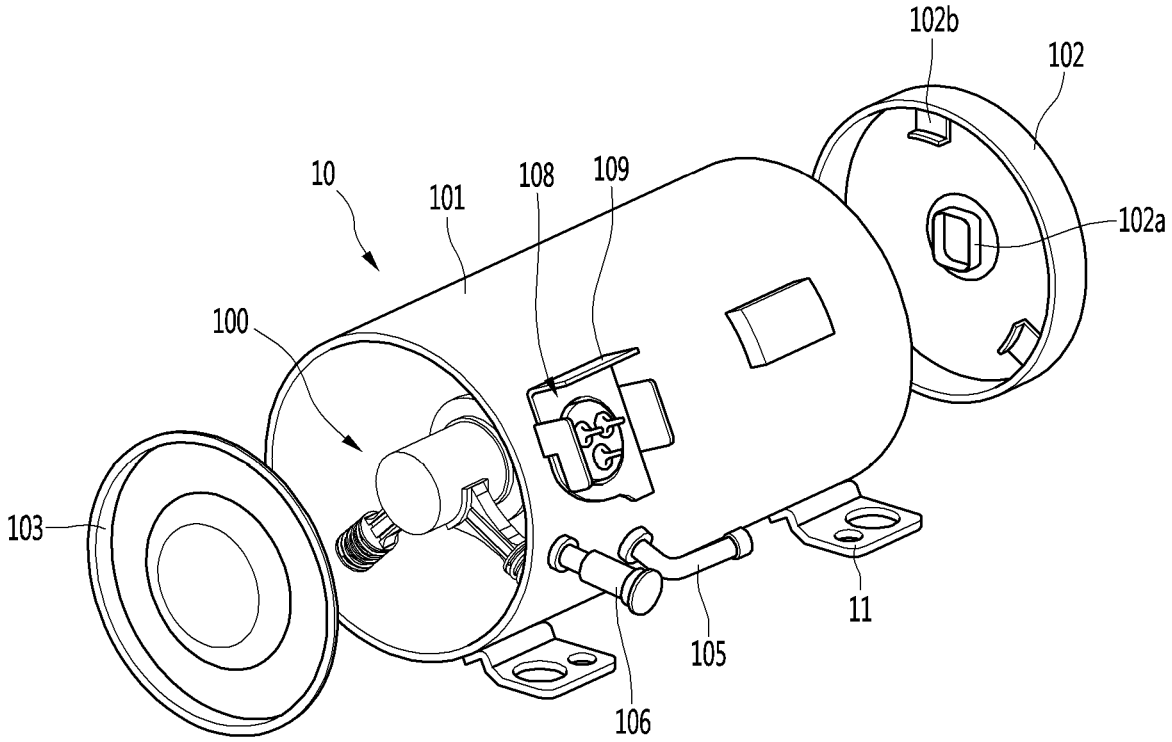
FIG. 3 is an exploded view illustrating a shell and a shell cover of the linear compressor according to the first embodiment.

FIG. 2 is a view illustrating an outer appearance of a linear compressor according to a first embodiment, and FIG. 3 is an exploded view illustrating a shell and a shell cover of the linear compressor according to the first embodiment.

Referring to FIGS. 2 and 3, a linear compressor 10 according to a first embodiment may include a shell 101 and shell covers 102 and 103 coupled to the shell 101. The shell cover may include a first shell cover 102 and a second shell cover 103.

In detail, a leg 11 may be coupled to a lower portion of the shell 101. The leg 11 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell 101 may have a lain cylindrical shape. When the linear compressor 10 is installed on the machine room base of the refrigerator, a machine room may be reduced in height. The shell 101 may have a cylindrical shape, but is not limited thereto.

A terminal block 108 may be installed on an outer surface of the shell 101. The terminal block 108 may be understood as a connection part for transferring external power to a motor assembly (see reference numeral 140 of FIG. 4) of the linear compressor 10.

A bracket 109 is installed outside the terminal block 108. The bracket 109 may protect the terminal block 108 against an external impact and the like.

Both ends of the shell 101 may be opened. The first and second shell covers 102 and 103 may be coupled to both ends of the opened shell 101. An inner space of the shell 101 may be sealed by the shell covers 102 and 103.

In FIG. 3, the first shell cover 102 may be disposed at a right portion (or a rear end) of the linear compressor 10, and the second shell cover 103 may be disposed at a left portion (or a front end) of the linear compressor 10. That is to say, the first and second shell covers 102 and 103 may be disposed to face each other.

The linear compressor 10 may further include a plurality of pipes 104, 105, and 106 provided in the shell 101 or the shell covers 102 and 103 to suction and discharge the refrigerant.

In detail, the plurality of pipes 104, 105, and 106 may include a suction pipe 104 through which the refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is adjacent to the second shell cover 103 rather than the first shell cover 102.

The process pipe 106 may be coupled to an outer circumferential surface of the shell 101. A worker may inject the refrigerant into the linear compressor 10 through the process pipe 106.

The process pipe 106 may be coupled to the shell 101 at a height different from that of the discharge pipe 105 to avoid interference with the discharge pipe 105. The height is understood as a distance from the leg 11 in the vertical direction (or the radial direction). Since the discharge pipe 105 and the process pipe 106 are coupled to the outer circumferential surface of the shell 101 at the heights different from each other, worker's work convenience may be improved.

A cover support part 102*a* is disposed on an inner surface of the first shell cover 102. A second support device 185 that will be described later may be coupled to the cover support part 102*a*. The cover support part 102*a* and the second support device 185 may be understood as devices for supporting a main body of the linear compressor 10.

Figure 4:
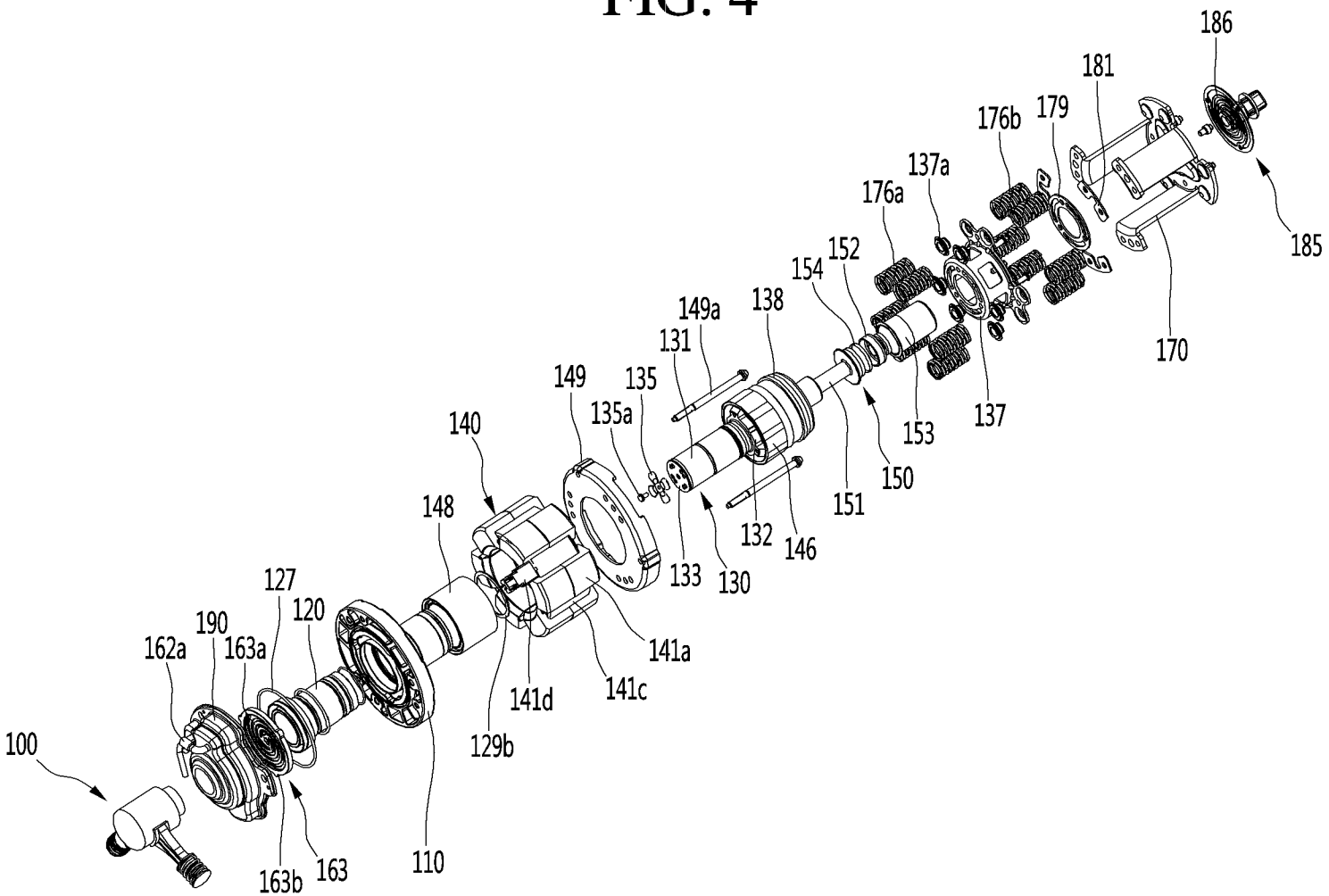
FIG. 4 is an exploded view illustrating a compressor body of the linear compressor according to the first embodiment.
Figure 5:
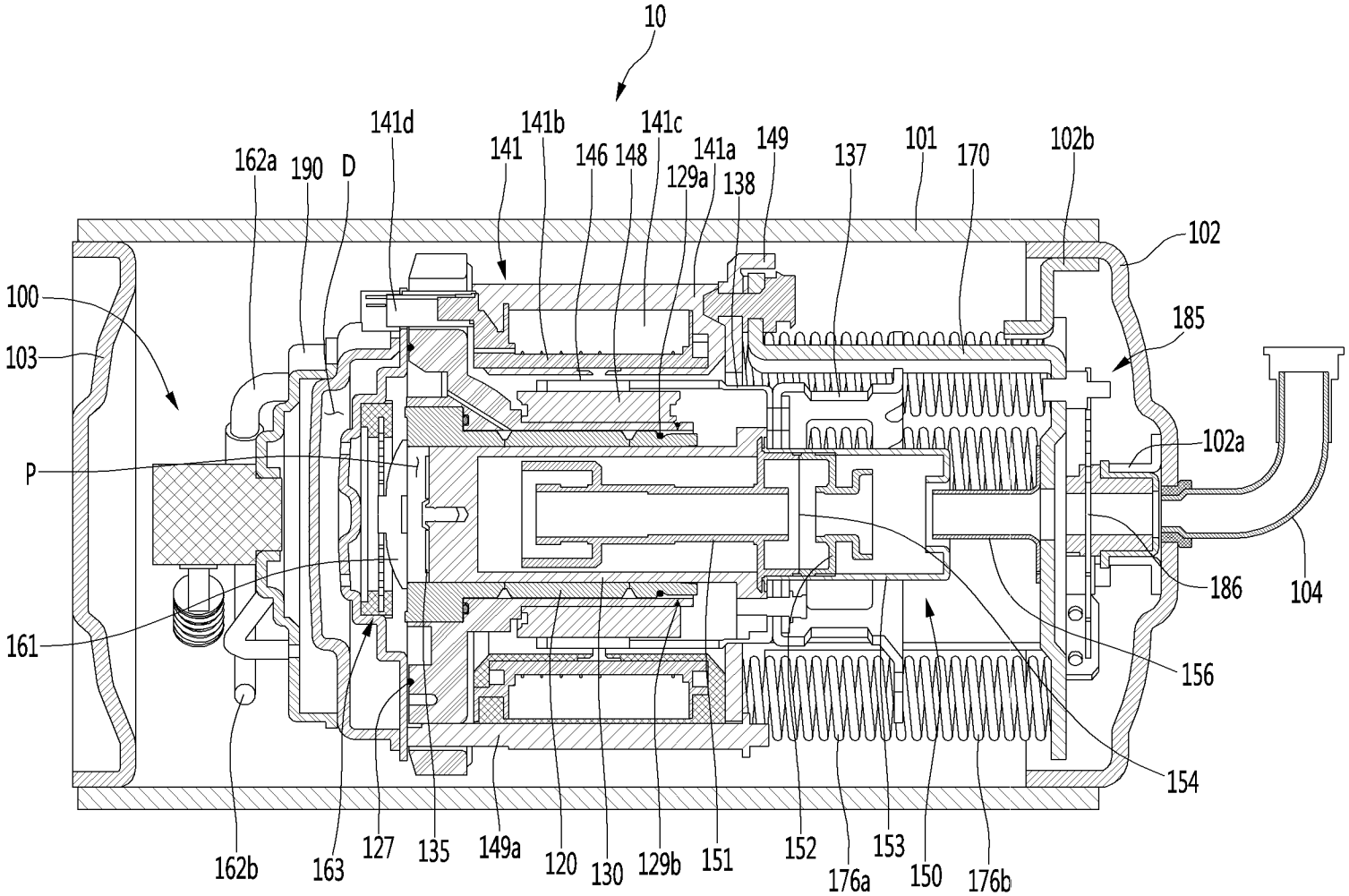
FIG. 5 is a cross-sectional view taken along line 5-5 of FIG. 2.

Here, the main body of the compressor represents a component set provided in the shell 101. For example, the main body may include a driving part that reciprocates forward and backward and a support part supporting the driving part. As illustrated in FIGS. 4 and 5, the driving part may include components such as the piston 130, a magnet frame 138, a permanent magnet 146, a supporter 137, and a suction muffler 150. Also, the support part may include components such as resonant springs 176*a* and 176*b*, a rear cover 170, a stator cover 149, a first support device 100, and a second support device 185.

A stopper 102*b* may be disposed on the inner surface of the first shell cover 102. The stopper 102*b* may be understood as a component for preventing the main body of the compressor, particularly, a motor assembly 140 from being bumped by the shell 101 and thus damaged due to the vibration or the impact occurring during the transportation of the linear compressor 10. The stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

FIG. 4 is an exploded view illustrating a compressor body of the linear compressor according to the first embodiment, and FIG. 5 is a cross-sectional view taken along line 5-5 of FIG. 2.

Figure 6:
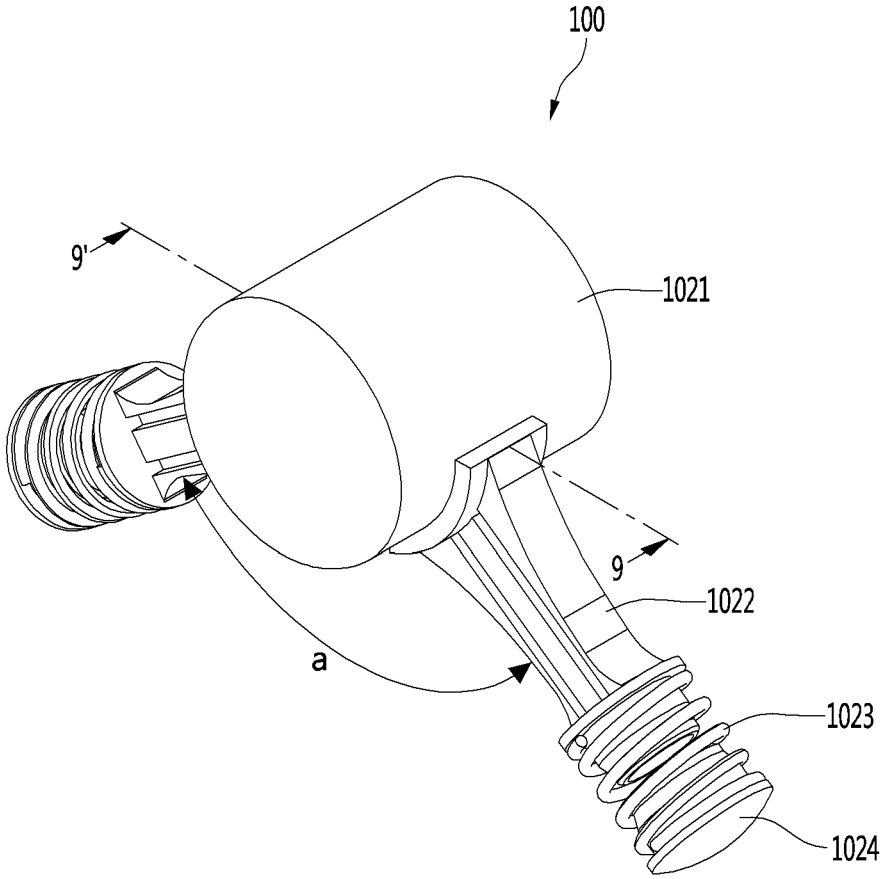
FIG. 6 is a view illustrating a first support device of the linear compressor according to the first embodiment.

Referring to FIGS. 5 and 6, the main body of the linear compressor 10, which is provided in the shell 101, according to the first embodiment may include a frame 110, a cylinder 120 inserted into a center of the frame 110, a piston 130 that linearly reciprocates within the cylinder 120, and the motor assembly 140 that gives driving force to the piston 130. The motor assembly 140 may be a linear motor that allows the piston 130 to linearly reciprocate in the axial direction of the shell 101.

In detail, the linear compressor 10 may further include the suction muffler 150. The suction muffler 150 may be coupled to the piston 130 to reduce noise generated from the refrigerant suctioned through the suction pipe 104. Also, the refrigerant suctioned through the suction pipe 104 flows into the piston 130 via the suction muffler 150. For example, while the refrigerant passes through the suction muffler 150, the flow noise of the refrigerant may be reduced.

The suction muffler 150 may include a plurality of mufflers. The plurality of mufflers may include a first muffler 151, a second muffler 152, and a third muffler 153, which are coupled to each other.

The first muffler 151 is disposed within the piston 130, and the second muffler 152 is coupled to a rear end of the first muffler 151. Also, the third muffler 153 accommodates the second muffler 152 therein, and a front end of the third muffler 153 may be coupled to the rear end of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

A muffler filter 154 may be mounted on the suction muffler 150. The muffler filter 154 may be disposed on an interface on which the first muffler 151 and the second muffler 152 are coupled to each other. For example, the muffler filter 154 may have a circular shape, and an edge of the muffler filter 154 may be disposed and supported between coupling surfaces of the first and second mufflers 151 and 152.

Here, the "axial direction" may be understood as a direction corresponding to the reciprocating direction of the piston 130, i.e., an extension direction of the longitudinal central axis of the cylindrical shell 101. Also, in the "axial direction", a direction from the suction pipe 104 toward a compression space P, i.e., a direction in which the refrigerant flows may be defined as a "frontward direction", and a direction opposite to the frontward direction may be defined as a "rearward direction". When the piston 130 moves forward, the compression space P may be compressed.

On the other hand, the "radial direction" may be defined as a radial direction of the shell 101, i.e., a direction perpendicular to the reciprocating direction of the piston 130.

The piston 130 may include a piston body 131 having an approximately cylindrical shape and a piston flange part 132 extending from a rear end of the piston body 131 in the radial direction. The piston body 131 may reciprocate inside the cylinder 120, and the piston flange part 132 may reciprocate outside the cylinder 120. The piston body 131 is configured to accommodate at least a portion of the first muffler 151.

The cylinder 120 has a compression space P in which the refrigerant is compressed by the piston 130. Also, a plurality of suction holes 133 are defined in a portion that is spaced a predetermined distance from a center of a front surface of the piston body 131 in the radial direction.

In detail, the plurality of suction holes 133 may be arranged to be spaced apart from each other in a circumferential direction of the piston 130, and the refrigerant may be introduced into the compression space P through the plurality of suction holes 133. The plurality of suction holes 133 may be disposed to be spaced a predetermined distance from each other in the circumferential direction of the front surface of the piston 130 or may be provided in a plurality of groups.

Also, a suction valve 135 that selectively opens the suction hole 133 is provided at the front of the suction hole 133.

Also, the suction valve 135 is fixed to a front surface of the piston body 131 by a coupling member 135*a* such as a screw or a bolt.

A discharge cover 190 defining a discharging space D for the refrigerator discharged into the compressor space P and a discharge valve assembly coupled to the discharge cover 190 to discharge the refrigerant compressed in the compression space P to the discharge space D are provided at a front side of the compression space P.

The discharge cover 190 may be provided in a form in which a plurality of covers are laminated. Also, a coupling hole or coupling groove to which the first support device 100 is coupled may be defined at a center of the discharge cover coupled to the outermost side (or the frontmost side) of the plurality of covers.

The discharge valve assembly may include a discharge valve 161 and a spring assembly 163 providing elastic force in a direction in which the discharge valve 161 contacts the front end of the cylinder 120.

In detail, the discharge valve 161 may be separated from the front surface of the cylinder when a pressure in the compression space P is greater than a discharge pressure to discharge the compressed refrigerant into the discharge space D defined in the discharge cover 190.

Also, when the pressure in the compression space P is greater than the discharge pressure D, the spring assembly 242 may be contracted so that the discharge valve 161 is spaced apart from the front end of the cylinder 120.

The spring assembly 163 includes a valve spring 163*a* and a spring support part 163*b* supporting the valve spring 163*a* to the discharge cover 190. For example, the valve spring 163*a* may include a plate spring.

The discharge valve 161 is coupled to the valve spring 163*a*, and a rear portion or a rear surface of the discharge valve 161 is disposed to be supported to contact the front surface of the cylinder 120.

When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is less than a suction pressure of the refrigerant, the suction valve 135 may be opened to suction the refrigerant into the compression space P.

On the other hand, when the pressure in the compression space P is greater than the suction pressure of the refrigerant, the suction valve 135 is closed, and the piston moves forward to compress the refrigerant within the compression space P.

When the pressure in the compression space P is greater than the pressure (discharge pressure) in the discharge space D, the valve spring 163*a* is deformed forward to separate the discharge valve from the cylinder 120. Also, the refrigerant within the compression space P is discharged into the discharge space D through a gap between the discharge valve 161 and the cylinder 120.

When the refrigerant is completely discharged, the valve spring 163*a* may provide a restoring force to the discharge valve 161 so that the discharge valve 161 contacts again the front end of the cylinder 120.

The linear compressor 10 may further include a cover pipe 162*a*. The cover pipe 162*a* is coupled to the discharge cover 190 to discharge the refrigerant flowing into the discharge space D defined in the discharge cover 190 to the outside.

Also, the linear compressor 10 may further include a loop pipe 162. One end of the loop pipe 162*b* is coupled to a discharge end of the cover pipe 162*a*, and the other end is connected to the discharge pipe 105 provided in the shell 101.

The loop pipe 162*b* may be made of a flexible material and have a length that is relatively longer than that of the cover pipe 162*a*. Also, the loop pipe 162*b* may roundly extend from the cover pipe 162*a* along the inner circumferential surface of the shell 101 and be coupled to the discharge pipe 105.

The frame 110 may be understood as a component for fixing the cylinder 120. For example, the cylinder 120 may be inserted into a central portion of the frame 110. Also, the discharge cover 190 may be coupled to a front surface of the frame 110 by using a coupling member.

The motor assembly 140 may include an outer stator 141 fixed to the frame 110 to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148.

In detail, the magnet frame 138 may be coupled to the piston flange part 132 to extend forward (axial direction). The permanent magnet 146 may be attached to an end of the magnet frame 138 or an outer circumferential surface of the magnet frame 138. When the permanent magnet 146 reciprocates in the axial direction, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. Also, the coil winding bodies 141*b*, 141*c*, and 141*d* may further include a terminal part 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149.

The linear compressor 10 may further include a cover coupling member 149*a* for coupling the stator cover 149 to the frame 110. The cover coupling member 149*a* may pass through the stator cover 149 to extend forward to the frame 110 and then be coupled to the frame 110.

The inner stator 148 is fixed to an outer circumference of the frame 110. Also, in the inner stator 148, the plurality of laminations are laminated outside the frame 110 in the circumferential direction.

The linear compressor 10 may further include a supporter 137 supporting the rear end of the piston 130. The supporter 137 may be coupled to the rear portion of the piston 130 and have the hollow part so that the muffler 150 passes through the inside of the supporter 137.

The piston flange part 132, the magnet frame 138, and the supporter 137 may be coupled to each other by using a coupling member to form one body.

A balance weight 179 may be coupled to the supporter 137. A weight of the balance weight 179 may be determined based on a driving frequency range of the compressor body.

The linear compressor 10 may further include the rear cover 170. The rear cover 170 is coupled to the stator cover 149 to extend backward and then is supported by a second support device 185.

In detail, the rear cover 170 includes three support legs, and the three support legs may be coupled to a rear surface of the stator cover 149. A spacer 181 may be disposed between the three support legs and the rear surface of the stator cover 149. A distance from the stator cover 149 to a rear end of the rear cover 170 may be determined by adjusting a thickness of the spacer 181. Also, the rear cover 170 may be spring-supported by the supporter 137.

The linear compressor 10 may further include an inflow guide part 156 coupled to the back cover 170 to guide an inflow of the refrigerant into the muffler 150. At least a portion of the inflow guide part 156 may be inserted into the suction muffler 150.

The linear compressor 10 may include a plurality of resonant springs that are adjusted in natural frequency to allow the piston 130 to perform a resonant motion.

In detail, the plurality of resonant springs may include a plurality of first resonant springs 176*a* supported between the supporter 137 and stator cover 149 and a plurality of second resonant springs 176*b* supported between the supporter 137 and rear cover 170.

The compressor body may stably reciprocate within the shell 101 of the linear compressor 10 due to operations of the plurality of resonant springs to minimize an occurrence of vibration or noise due to the movement of the piston 130.

The supporter 137 may include a first spring support part 137*a* coupled to the first resonant spring 176*a*.

The linear compressor 10 may include the frame 110 and a plurality of sealing members for increasing coupling force between components around the frame 110.

In detail, the plurality of sealing members may include a first sealing member 127 disposed at a portion at which the frame 110 and the discharge cover 190 are coupled to each other.

The plurality of sealing members may further include a second sealing member 129*a* disposed between the cylinder 120 and the frame 110.

The plurality of sealing members may further include a third sealing member 128 disposed at a portion at which the frame 110 and the inner stator 148 are coupled to each other.

Each of the first to third sealing members 127,129*a* and 129*b* may have a ring shape.

The linear compressor 10 may further include a first support device 100 supporting the front end of the main body of the compressor 10. In detail, as illustrated in FIG. 5, the first support device 100 is inserted into a coupling hole or coupling groove which is defined in a center of the front surface of the discharge cover 190. A structure of the first support device 100 will be described with reference to the following drawings.

The linear compressor 10 may further include a second support device 185 supporting the rear end of the main body of the compressor 10. The second support device 185 is coupled to the rear cover 170. The second support device 185 may be coupled to the first shell cover 102 to elastically support the main body of the compressor 10. In detail, the second support device 185 may include a second support spring 186, and the second support spring 186 may be coupled to the cover supporter 102*a*.

Figure 7:
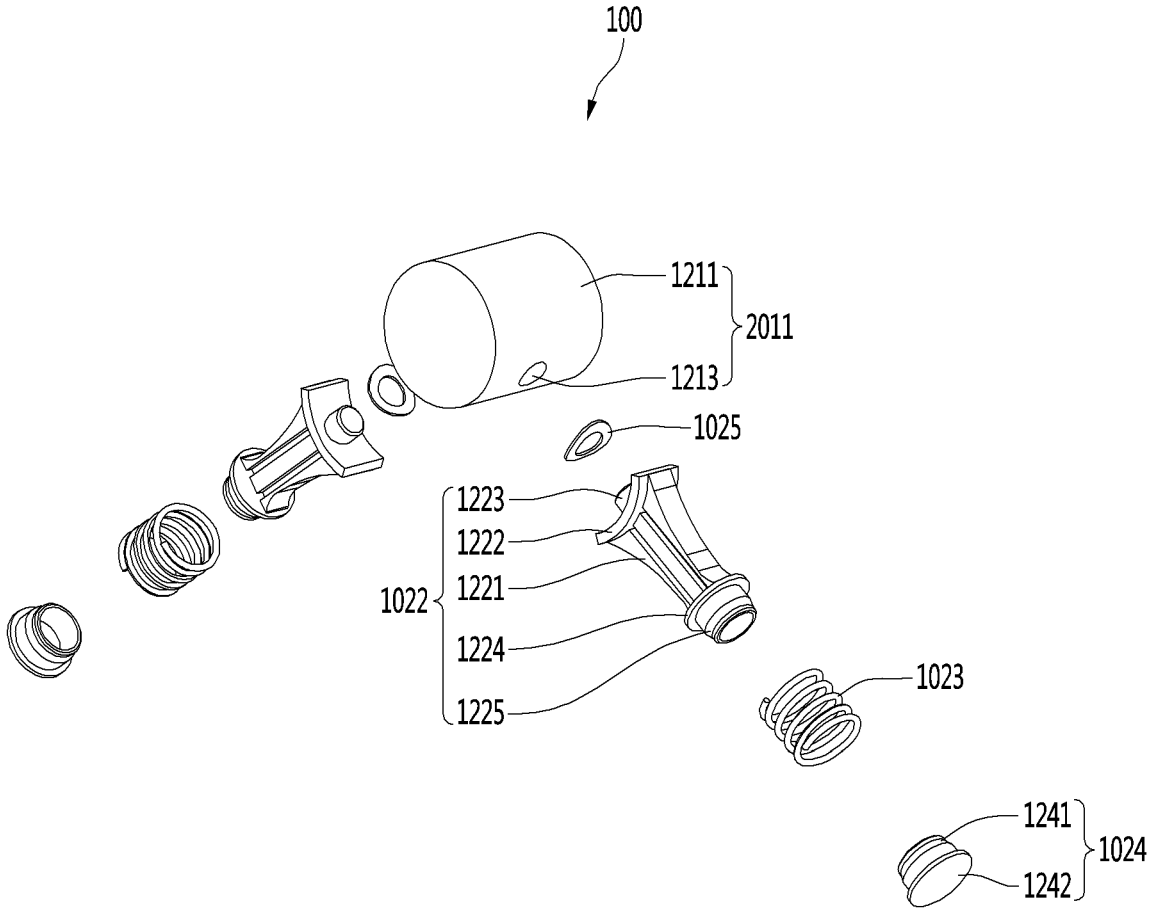
FIGS. 7 and 8 are exploded views illustrating the first support device of the linear compressor according to the first embodiment.
Figure 8:
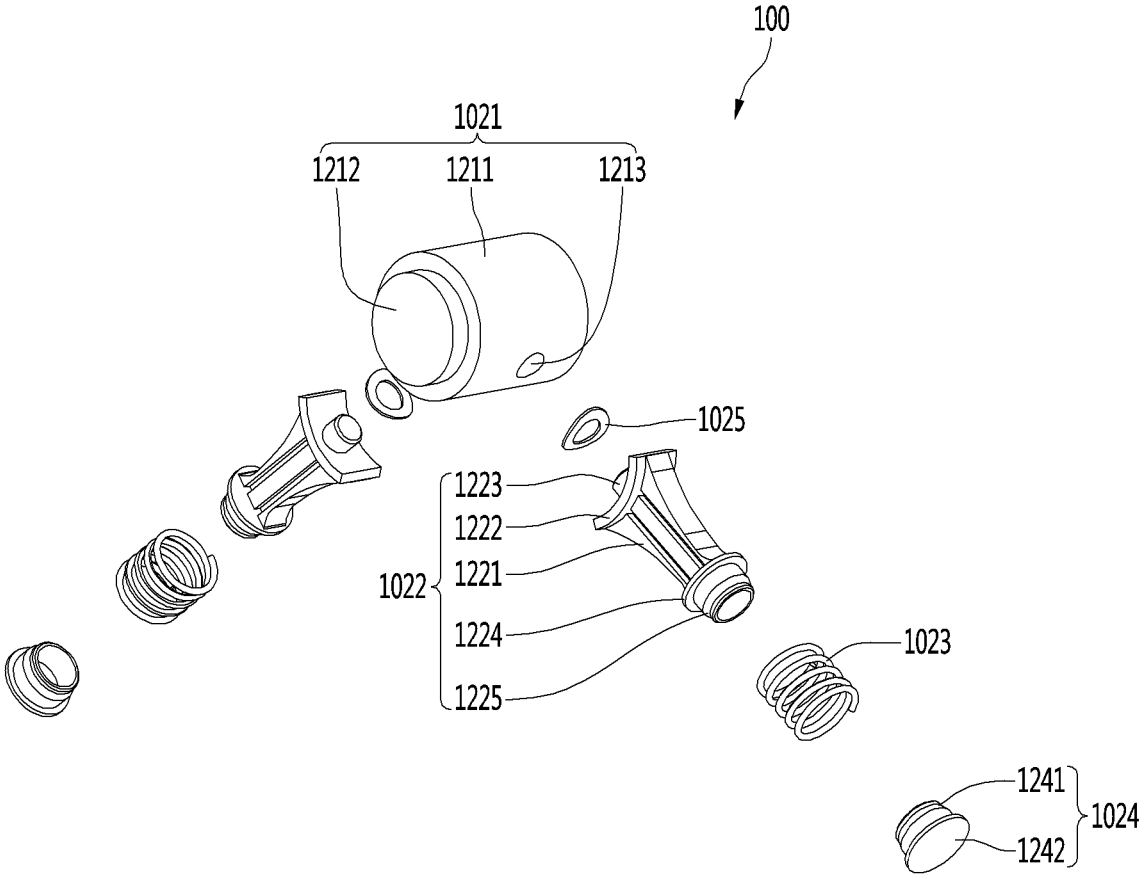
Figure 9:
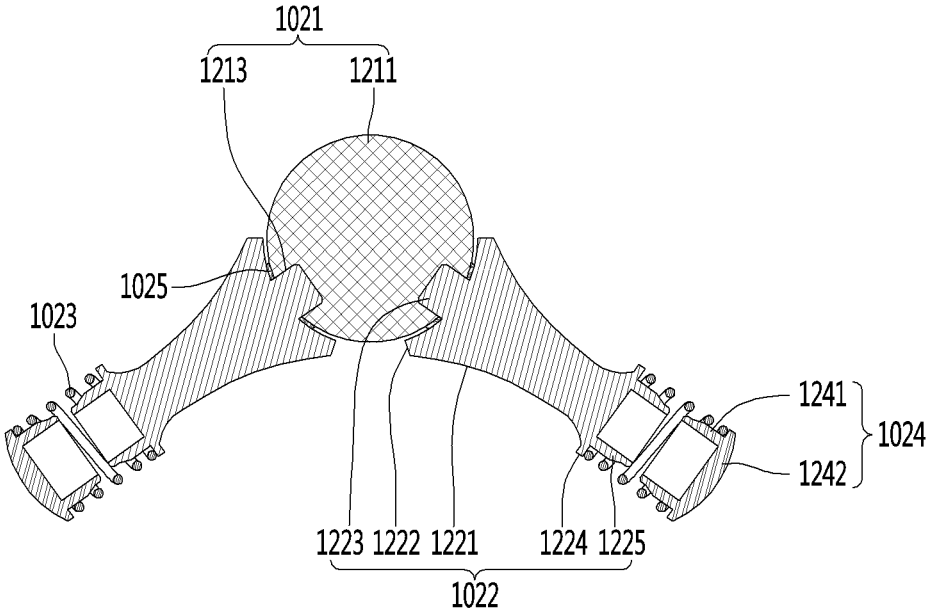
FIG. 9 is a cross-sectional view taken along line 9-9 of FIG. 6.

FIG. 6 is a view illustrating the first support device of the linear compressor according to the first embodiment, and FIGS. 7 and 8 are exploded views illustrating the first support device of the linear compressor according to the first embodiment. FIG. 9 is a cross-sectional view taken along line 9-9 of FIG. 6.

In detail, FIGS. 5 and 6 illustrate a front side of the first support device 100, and FIG. 7 illustrates a rear side of the first support device 100. Here, the front and rear sides mean front and rear sides in the axial direction. Also, the second shell cover 103 is disposed at the front side of the first support device 100 in the axial direction, and the discharge cover 190 is disposed at the rear side of the first support device 100 in the axial direction.

Referring to FIGS. 6 to 8, the first support device 100 according to the first embodiment includes a support head 1021 coupled to a center of a front surface of the discharge cover 190 and a pair of damping fitted inserted into the support head 1021.

In detail, the support head 1021 may include a cylindrical head body 1211 and an insertion protrusion 1212 protruding from a rear surface of the head body 1211. The insertion protrusion 1212 has a diameter less than that of the support head 1021 and is inserted and fixed to an insertion groove or an insertion hole, which is defined in the center of the front surface of the discharge cover 190.

Also, a pair of coupling grooves 1213 to which the pair of damping units are coupled are defined a side surface of the head body 1211, i.e., a surface (hereinafter, referred to as a circumferential surface) providing a cylindrical portion. The pair of coupling grooves 1213 may be defined in positions spaced a predetermined angle from each other along the circumferential surface of the head body 1211.

Also, the pair of damping units are respectively coupled to the pair of coupling grooves 1213 in a tangential direction perpendicular to the circumferential surface of the head body 1211. Also, the angle a defined by the pair of damping units may range from about 90 degrees to about 120 degrees, preferably, about 108 degrees.

In detail, each of the pair of damper units includes a support leg 1022, a buffer pad 1025 placed on a top surface of the support leg 1022 to contact the support head 1021, an elastic member 1023 having one end inserted into a lower end of the support leg 1022, and a shell seat 1024 inserted into the other end of the elastic member 1023 and seated on an inner circumferential surface of the shell 101. The elastic member 1023 includes a coil spring, and the buffer pad 1025 may be made of rubber, silicon, or plastic.

The support leg 1022 may include a leg body 1221, a head supporter 1222, a mounting protrusion 1223, a flange 1224, and an extension part 1225. The head supporter 1222 is rounded at a curvature corresponding to a circumferential curvature of the head body 1211 at an upper end of the leg main body 1221 to contact a circumferential surface of the head body 1221.

Also, the mounting protrusion 1223 protrudes from a center of the top surface of the head supporter 1222 by a predetermined length and is inserted into the coupling groove 1213 of the head body 1211. Also, the flange 1224 extends in the form of a circular rib at a lower end of the leg body 1221. Also, the extension part 1225 may have a diameter less than that of the flange 1224 on a bottom surface of the flange 1224 to extend by a predetermined length and may extend in the form of an empty sleeve.

Also, the extension part 1225 is inserted into the elastic member 1023, and one end of the elastic member 1023 is seated on the flange 1224.

Also, the shell seat 1024 may include a bottom part 1242 contacting an inner circumferential surface of the shell 101 and a support sleeve 1241 extending from a top surface of the bottom part 1242. The support sleeve 1241 is inserted into the elastic member 1023, and the other end of the elastic member 1023 is seated on the top surface of the bottom part 1242. Also, a bottom surface of the bottom part 1242 may have a shape in which a center thereof is convexly rounded.

Also, a through-hole through which the mounting protrusion 1223 passes is defined in a center of the buffer pad 1025. The buffer pad 1025 may have the same shape and size as the top surface of the head supporter 1222. That is to say, when the buffer pad 1025 is inserted into the mounting protrusion 1223, the top surface of the head supporter 1222 may be provided in a shape that is completely covered by the buffer pad 1025. In this embodiment, the buffer pad 1025 may have a rectangular shape having the through-hole defined in the center thereof, but may also have an oval or circular ring shape.

The extension part 1225 and the support sleeve 1241 do not contact each other but remain to be spaced apart from each other in a state in which the extension part 1225 of the support leg 1022 and the support sleeve 1241 of the shell seat 1024 are inserted into both ends of the elastic member 1023. Also, when the linear compressor 10 is driven to transmit the vibration to the support head 1021, the extension part 1225 and the support sleeve 1241 are repeatedly close to and away from each other by the elastic action of the elastic member 1023.

Here, an elastic modulus of the elastic member 1023 may be appropriately set so that the extension part 1225 and the support sleeve 1241 do not contact each other even when the vibration is generated, thereby preventing impact noise from occurring.

Also, since the pair of damping units connect the support head 1021 to the shell 101 in an inverted 'V' shape as illustrated in the drawings, not only the compressor body may be stably supported but also the damping unit and the support head 1021 may be stably connected to each other without using a coupling member such as a screw. Also, there is an advantage that a separate coupling member is not required even at a connection portion between the damping unit and the shell 101.

In detail, to mount the damping unit, the compressor body to which the support head 1021 is coupled at the center of the front surface is inserted into the shell. Also, the rear end of the compressor body is coupled to the first shell cover 102. In this state, the buffer pad 1025 is inserted into the mounting protrusion 1223, and then, the mounting protrusion 1223 is inserted into the coupling groove 1213 of the support head 1021. Also, the elastic member 1023 is mounted on the lower end of the support leg 1022, and the shell seat 1024 is inserted into the other end of the elastic member 1023 in a state in which the elastic member 1023 is contracted.

In this state, when a pressing force for contracting the elastic member 1023 is removed, the elastic member 1023 returns to its original position, and thus, the bottom part 1242 of the shell seat 1024 contacts the inner circumferential surface of the shell 101. Here, since the bottom surface of the bottom part 1242 has a shape in which a central portion is convexly rounded, a central portion of a bottom surface of the bottom part contacts the inner circumferential surface of the shell 101. The state in which the center of the bottom surface of the bottom part 1242 contacts the inner circumferential surface of the shell 101 may be an optimal state in which the vibration and noise of the compressor are absorbed best.

Figure 10:
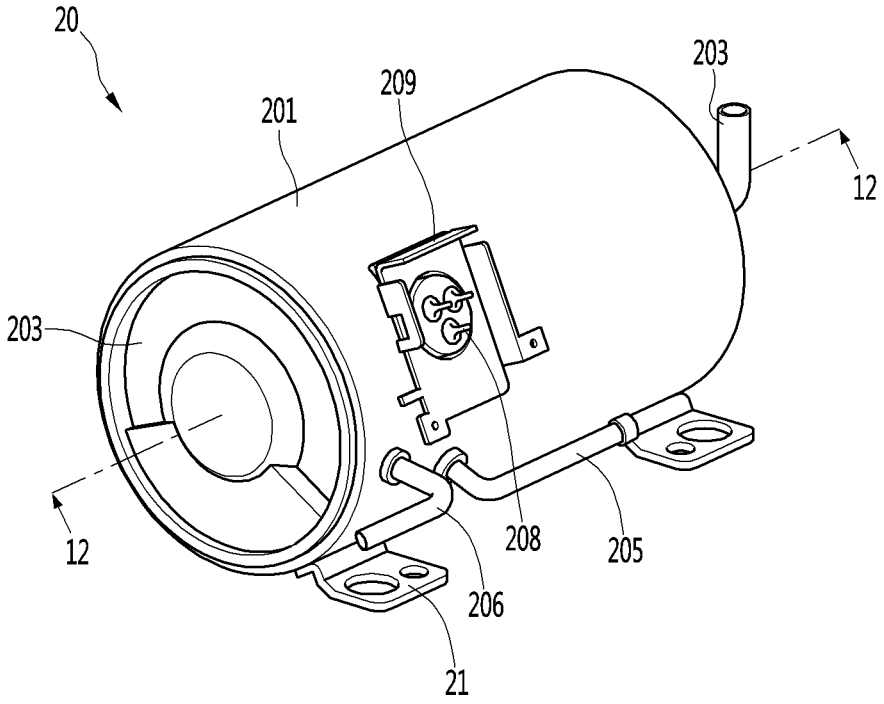
FIG. 10 is a view illustrating an outer appearance of a linear compressor according to a second embodiment.

FIG. 10 is a view illustrating an outer appearance of a linear compressor according to a second embodiment.

Referring to FIG. 10, a linear compressor 20 according to the second embodiment may include a shell 201 having a cylindrical shape and a pair of shell covers coupled to both ends of the shell 201. The pair of shell covers may include a first shell cover of a refrigerant suction-side and a second shell cover 203 of a refrigerant discharge-side.

Also, the linear compressor 20 includes a leg 21, a terminal block 208, a bracket 209, a suction pipe 204, a discharge pipe 205, and a process pipe 206. Such constituents are referred to the description of the first embodiment, and the description thereof is omitted.

The linear compressor according to the second embodiment is different from the linear compressor according to the first embodiment in a discharge-side structure. In detail, the structure adjacent to the second shell cover 203 is different, and the rest structure is provided the same. Thus, for the rest constituents that are not illustrated in the drawings, descriptions will be cited from the descriptions of the first embodiment, and duplicated descriptions will be omitted.

Figure 11:
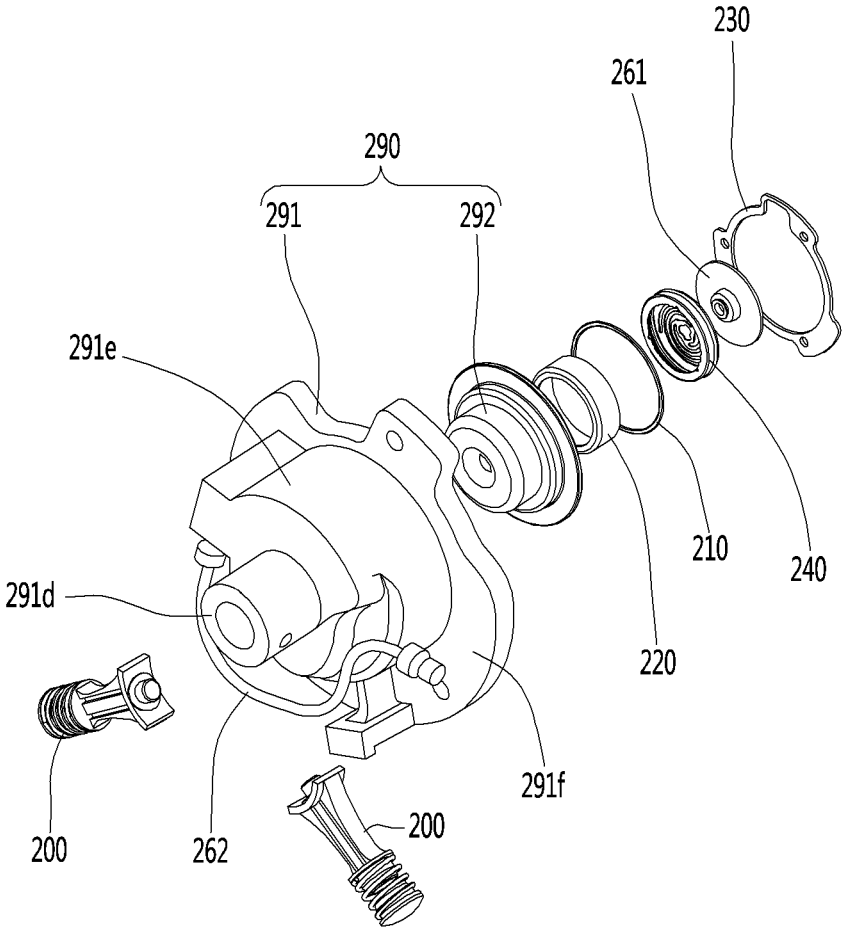
FIG. 11 is an exploded view illustrating a compressor body of the linear compressor according to the second embodiment.
Figure 12:
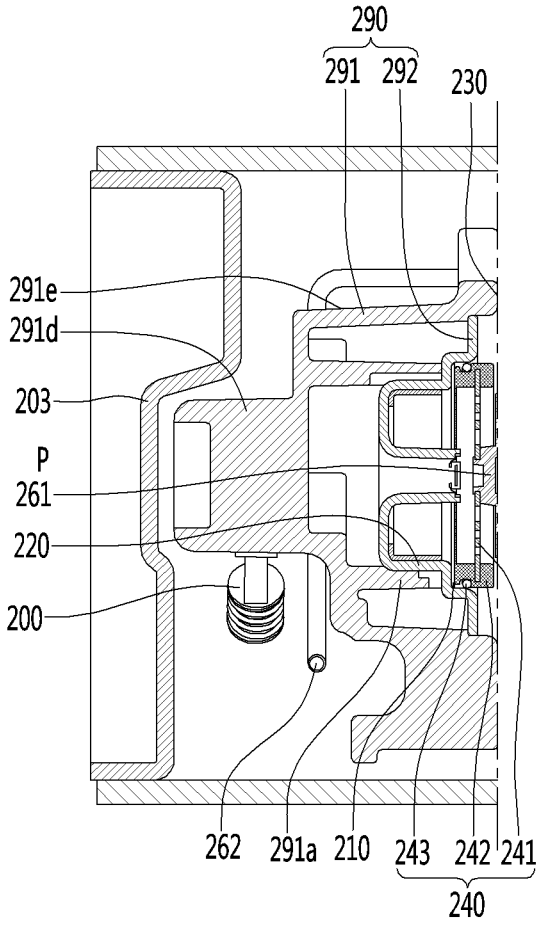
FIG. 12 is a cross-sectional view taken along line 12-12 of FIG. 10.

FIG. 11 is an exploded view illustrating a compressor body of the linear compressor according to the second embodiment, and FIG. 12 is a cross-sectional view taken along line 12-12 of FIG. 10.

As illustrated in FIGS. 11 and 12, the linear compressor 20 includes a discharge cover 290 defining a discharge space D.

A discharge cover 290 providing a discharging space for a refrigerator discharged into the compressor space P and a discharge valve assembly coupled to the inside of the discharge cover 290 to discharge the refrigerant compressed in a compression space P to the discharge space are provided at a front side of the compression space P.

The discharge cover 290 may be provided in a shape in which a plurality of covers are laminated. Also, a coupling hole or coupling groove 291W (see FIG. 13) to which a first support device 200 that will described below is coupled may be defined in the discharge cover coupled to the outermost side (or the frontmost side) of the, plurality of covers.

In detail, the discharge cover 290 includes a cover housing 291 fixed to the front surface of the frame 110 and a discharge cover body 292 disposed inside the cover housing 291. Also, the discharge cover 290 may further include a cylindrical fixing ring 220 that contacts an inner circumferential surface of the discharge cover body 292. The fixing ring 220 may be made of a material having a thermal expansion coefficient different from that of the discharge cover body 292 to prevent the discharge cover body 292 from being separated from the cover housing 291.

That is, the fixing ring 220 is made of a material having a thermal expansion coefficient greater than that of the discharge cover body 292 and is expanded while receiving heat from the refrigerant discharged from the compression space P so that the discharge cover body 292 contacts the cover housing 291. Thus, possibility that the discharge cover body 292 is separated from the cover housing 291 may be reduced. For example, the discharge cover body 292 may be made of engineering plastic that withstands a high temperature, the cover housing 291 may be made of aluminum die cast, and the fixing ring 220 may be made of stainless steel.

Also, the discharge valve assembly may include a discharge valve 261 and a spring assembly 240 providing elastic force in a direction in which the discharge valve 261 contacts the front end of the cylinder 120.

In detail, the discharge valve 261 may be separated from the front surface of the cylinder when a pressure in the compression space P is greater than a discharge pressure to discharge the compressed refrigerant into the discharge space (or a discharge chamber) defined in the discharge cover body 292.

The spring assembly 240 may include a valve spring 242 having a plate spring shape, a spring support part 241 surrounded on an edge of the valve spring 242 to support the valve spring 242, and a friction ring 243 inserted into an outer circumferential surface of the spring support part 241.

Also, when the pressure in the compression space P is greater than the discharge pressure, the valve spring 242 may be elastically deformed toward the discharge cover body 292, and thus, the discharge valve 261 may be spaced apart from the front end of the cylinder 120.

A central portion of a front surface of the discharge valve 261 is fixed and coupled to a center of the valve spring 242, and a rear surface of the discharge valve 261 contacts the front surface (or the front end) of the cylinder 120 by the elastic force of the valve spring 242.

When the discharge valve 261 is supported on the front surface of the cylinder 120, the compression space may be maintained in the sealed state. When the discharge valve 261 is spaced apart from the front surface of the cylinder 120, the compression space P may be opened to allow the refrigerant in the compression space P to be discharged.

The compression space P may be understood as a space defined between the suction valve 135 and the discharge valve 261. Also, the suction valve 135 may be disposed on one side of the compression space P, and the discharge valve 261 may be disposed on the other side of the compression space P, i.e., an opposite side of the suction valve 135.

While the piston 130 linearly reciprocates within the cylinder 120, when the pressure of the compression space P is less than a suction pressure of the refrigerant, the suction valve 135 may be opened to suction the refrigerant into the compression space P.

On the other hand, when the pressure in the compression space P is greater than the suction pressure of the refrigerant, the suction valve 135 is closed, and the piston moves forward to compress the refrigerant within the compression space P.

When the pressure in the compression space P is greater than the pressure (the discharge pressure) in the discharge space, the valve spring 242 is deformed forward to separate the discharge valve 261 from the cylinder 120. Also, the refrigerant within, the compression space P is discharged into the discharge space defined in the discharge cover body 292 through a gap between the discharge valve 161 and the cylinder 120.

When the refrigerant is completely discharged, the valve spring 242 may provide restoring force to the discharge valve 261 so that the discharge valve 261 contacts again to the front end of the cylinder 120.

Also, a gasket 210 may be provided on the front surface of the spring support part 241. When the discharge valve 261 is opened, the spring assembly 240 may move in the axial direction to be directly bumped to the discharge cover body 292, thereby reducing noise from occurring.

The linear compressor 20 may further include a cover pipe 262. The cover pipe 262 is coupled to the cover housing 291 to discharge the refrigerant, which is discharged from the compression space P to the discharge space within the discharge cover 290, to the outside. For this, the cover pipe 262 has one end coupled to the cover housing 291 and the other end coupled to the discharge pipe 205 provided in the shell 201.

The cover pipe 262 may be made of a flexible material and roundly extend along the inner circumferential surface of the shell 201.

The frame 110 may be understood as a component for fixing the cylinder 120. For example, the cylinder 120 may be inserted in the axial direction of the shell 101 at the central portion of the frame 110. Also, the discharge cover 290 may be coupled to the front surface of the frame 110 by a coupling member.

Also, an insulation gasket 230 may be disposed between the cover housing 291 and the frame 110. In detail, the insulation gasket 230 may be disposed on the front surface of the frame 110 contacting the rear surface or the rear end of the cover housing 291 to prevent heat of the discharge cover 290 from being transferred to the frame 110.

The linear compressor 20 may further include a pair of first support devices 200 supporting the front end of the compressor body. In detail, each of the pair of first support devices 200 has one end fixed to the discharge cover 290 and the other end that contacts the inner circumferential surface of the shell 101. Also, the pair of second support devices 200 are spread at a range of angle of about 90 degrees to about 120 degrees to support the discharge cover 290.

In detail, the cover housing 291 constituting the discharge cover 290 may include a flange part 291*f* that contacts a front surface of the frame, a chamber part 291*e* provided in the axial direction of the shell 101 at an inner edge of the flange part 291*f*, a support device fixing part 291*d* further extending from a front surface of the chamber part 291*e*, and a partition sleeve 291*a* extending from the inside of the chamber part 291*e*.

Also, an end of each of the pair of first support devices 200 is fixed to an outer circumferential surface of the support device fixing part 291*d*. A coupling groove (not shown) may be defined in an outer circumferential surface of the support device fixing part 291*d* to which a coupling protrusion (not shown) protruding from a front end of the first support device 200 is inserted.

Also, the outer diameter of the support device fixing part 291*d* may be less than that of the front portion of the chamber part 291*e*.

As illustrated in the drawings, the first support device 200 according to the second embodiment is the same as the damping unit of the first support device 100 according to the first embodiment. Thus, the description of the damping unit described in the first embodiment is cited, and the duplicated description is omitted.

In comparison, the first support device 100 according to the first embodiment is provided with a separate support head 1021. However, the second support device 200 according to the second embodiment may not be provided with the support head 1021. This is because the support device fixing part 291*d* corresponding to the support head 1021 is provided in the discharge cover 290 according to the second embodiment.

As described above, this is because the discharge-side structures of the first embodiment and the second embodiment are different from each other. Hereinafter, the discharge cover 290 will be described in detail.

Figure 13:
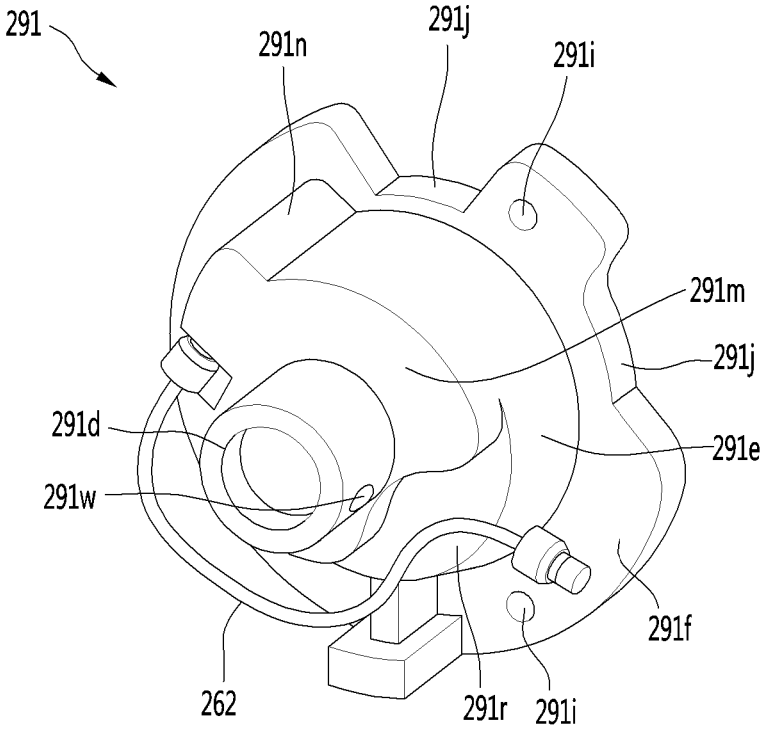
FIG. 13 is a view illustrating a cover housing of the linear compressor according to the second embodiment.
Figure 14:
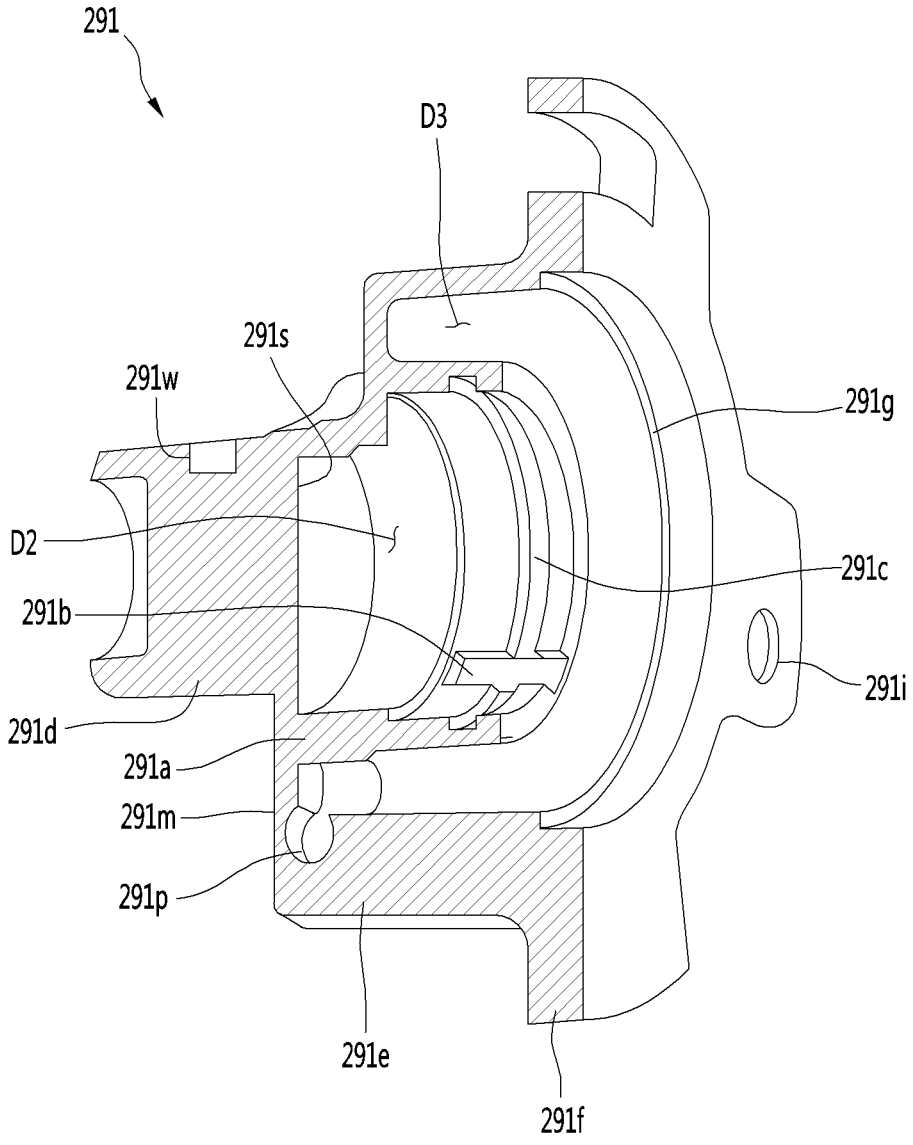
FIG. 14 is a cross-sectional view illustrating the cover housing of the linear compressor according to the second embodiment.
Figure 15:
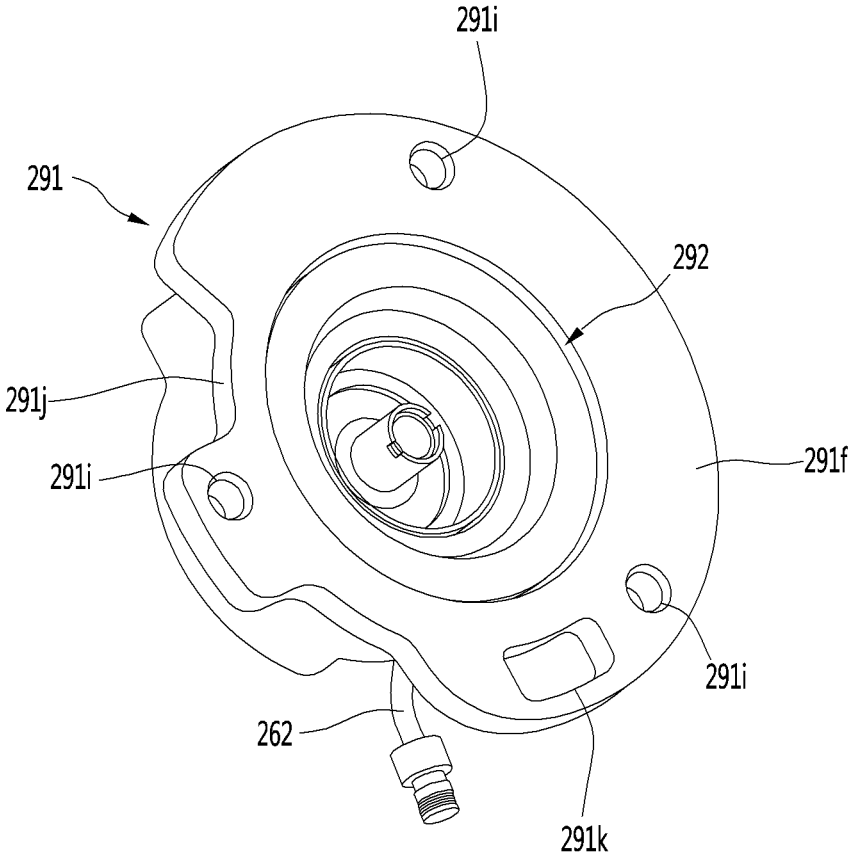
FIG. 15 is a view illustrating a discharge cover of the linear compressor according to the second embodiment.
Figure 16:
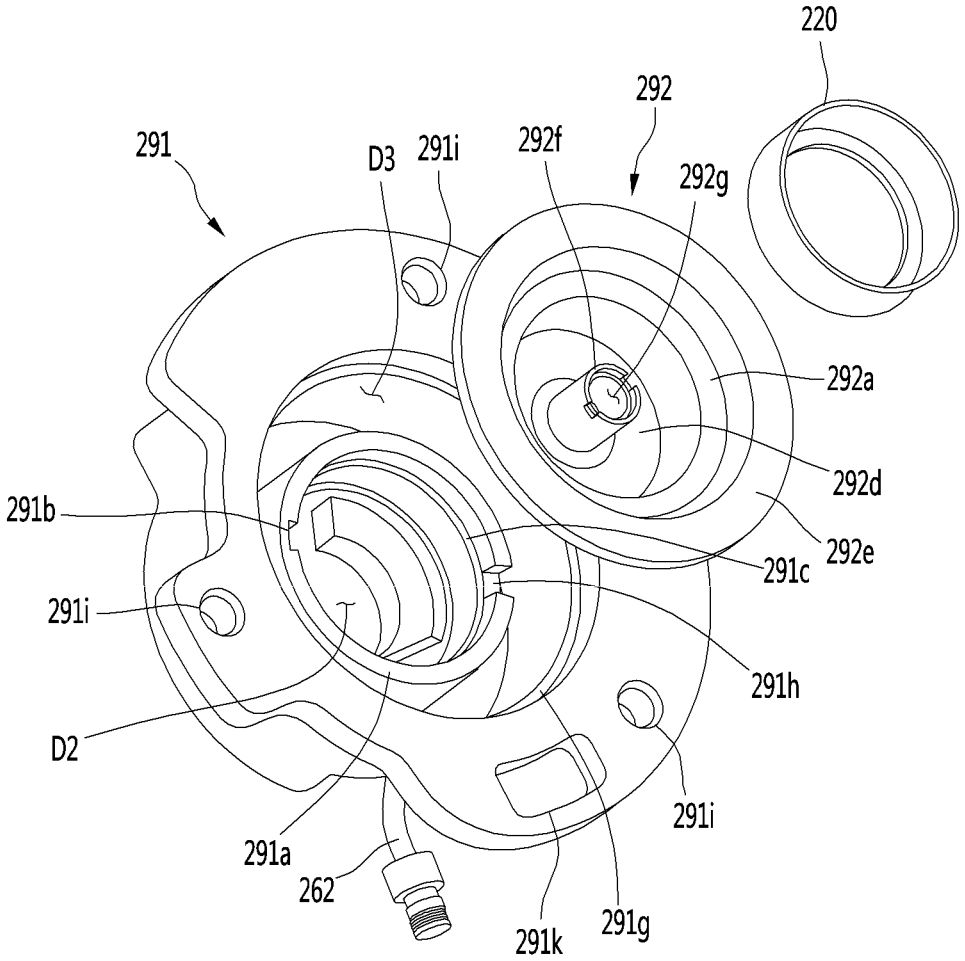
FIG. 16 is an exploded view illustrating the discharge cover of the linear compressor according to the second embodiment.
Figure 17:
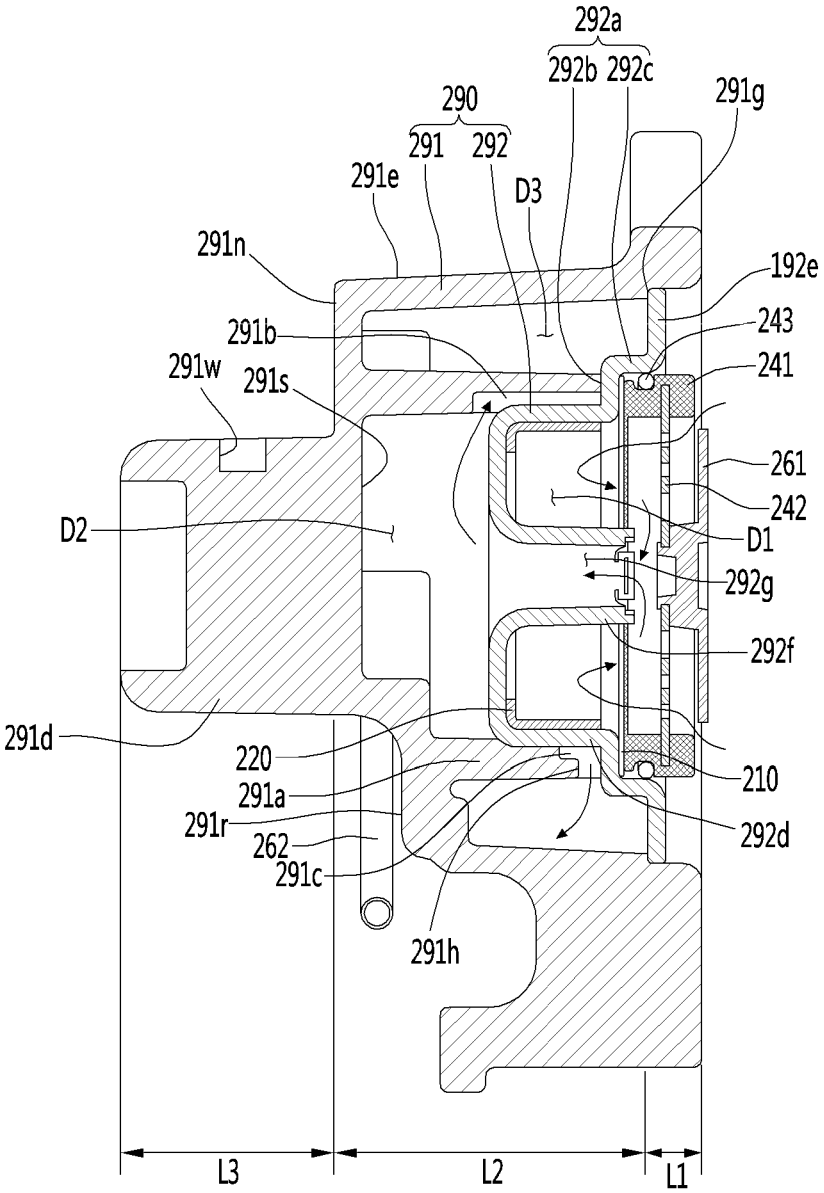
FIG. 17 is a view illustrating a flow of a refrigerant in the discharge cover of the linear compressor according to the second embodiment.

FIG. 13 is a view illustrating a cover housing of the linear compressor according to the second embodiment, and FIG. 14 is a cross-sectional view illustrating the cover housing of the linear compressor according to the second embodiment. FIG. 15 is a view illustrating a discharge cover of the linear compressor according to the second embodiment, and FIG. 16 is an exploded view illustrating the discharge cover of the linear compressor according to the second embodiment. Also, FIG. 17 is a view illustrating a flow of a refrigerant in the discharge cover of the linear compressor according to the second embodiment.

Referring to FIGS. 13 to 17, as described above, a discharge cover 290 includes an outer cover housing 291, a discharge cover body 292 mounted inside the cover housing 291, and a fixing ring 220 inserted into an inner circumferential surface of the discharge cover body 292.

In another aspect, one of the cover housing 291 and the discharge cover body 292 may be defined as a first discharge cover, and the other may be defined as a second discharge cover.

The cover housing 291 may be die casting aluminum, the discharge cover body 292 may be an engineering plastic, and the fixing ring 220 may be stainless steel. Also, a valve spring assembly 240 may be seated at a rear end of the discharge cover body 292.

The cover housing 291 according to the second embodiment is fixed to a front surface of the frame 110, the refrigerant discharge space is defined in the cover housing 291.

For example, the cover housing 291 may have a container shape as a whole. That is, the cover housing 291 may provide a discharge space with an opened rear surface, and the discharge cover body 292 may be inserted to seal the open rear surface of the cover housing 291.

Particularly, the cover housing 291 according to this embodiment is characterized by being integrally manufactured through aluminum die casting. Thus, unlike the cover housing according to the related art, in the case of the cover housing 291 according to this embodiment, a welding process may be omitted. Thus, a process of manufacturing the discharge cover 291 may be simplified, resulting in minimizing product defects, and product cost may be reduced. In addition, since the welding process is omitted, a dimensional tolerance due to the welding is significantly reduced. Thus, there is no gap in the cover housing 291, and as a result, leakage of the refrigerant is prevented.

Particularly, referring to FIGS. 13 and 14, the cover housing 291 includes a flange part 291*f* contacting a front surface of a frame, a chamber part 291*e* extending from an inner edge of the flange part 291*f* in an axial direction of the shell 201, and a support device fixing part 291*d* further extending from a front surface of the chamber part 291*e*.

Each of the chamber part 291*e* and the support device fixing part 291*d* may have a cylindrical shape. Also, an outer diameter of the chamber part 291*e* may be less than that of the flange part 291*f*, and the outer diameter of the support device fixing part 291*d* may be smaller than the outer diameter of the chamber part 291*e*.

The flange part 291*f* is bent from a rear end of the chamber part 291*e* to contact a front surface of the frame. That is, the flange part 291*f* may extend outward from the rear end of the chamber part 291*e*.

In another aspect, the flange part 291*f* may have a disk shape having a through-hole defined in a center thereof. The through-hole may have a circular shape.

Also, a coupling hole 291*i* may be defined in the flange part 291*f* so to be coupled to the frame by a coupling member.

The coupling holes 291*i* may be provided in plurality that are spaced apart from each other. For example, the coupling holes 291*i* may be provided in three and may be spaced apart from each other at equal intervals in a circumferential direction of the flange part 291*f*. That is, since the flange part 291*f* is supported by the frame at three points, the cover housing 291 may be strongly fixed to the front surface of the frame 110.

Also, a rotation prevention part 291*j* that prevents the cover housing 291 from rotating while being mounted to the frame 110 may be disposed on an outer circumferential surface of the flange part 291*f*. The rotation prevention part 291*j* may be recessed in a central direction of the flange part 291*f* in an outer circumferential surface of the flange part 291*f*.

Also, a rotation preventing hole 291*k* may be defined in the flange part 291*f* to prevent the cover housing 291 from rotating in a state in which the cover housing 291 is mounted on the frame 110. The rotation prevention hole 291*k* may be defined to pass from a front side to a rear side of the flange part 291*f*.

The chamber part 291*e* extends in the axial direction of the shell 101 from a front surface of the flange part 291*f*. Particularly, the chamber part 291*e* may extend in the axial direction of the shell 201 inside the through-hole defined in the flange part 291*f*.

The chamber 291*e* may extend in a cylindrical shape with an empty therein. Also, a discharge space through which a refrigerant flows may be provided in the chamber 291*e*.

A partition sleeve 291*a* may be provided inside the chamber 291*e* to partition an inner space of the chamber 291*e*.

The partition sleeve 291*a* may extend in a cylindrical shape inside the chamber part 291*e*. Particularly, the partition sleeve 291*a* may protrude backward from the front surface 291*m* of the chamber part 291*e*. Here, an outer diameter of the partition sleeve 291*a* is less than that of the chamber part 291*e*. Thus, the inner space of the chamber part 291*e* may be partitioned by the partition sleeve 291*a*.

In another aspect, the partition sleeve 291*a* may extend from a rear surface 291*s* of a front surface portion 291*m* of the chamber part 291*e* toward a rear side of the chamber part 291*e*.

In this embodiment, a space corresponding to the inside of the partition sleeve 291*a* may be defined as a second discharge chamber D2, and an outer space of the partition sleeve 291*a* may be defined as a third discharge chamber D3. That is, the discharge space of the chamber part 291*e* is divided into the second discharge chamber D2 and the third discharge chamber D3 by the partition sleeve 291*a*.

Here, the second discharge chamber D2 may be referred to as an "inner space", and the third discharge chamber D3 may be referred to as an "outer space".

Also, a first guide groove 291*b* and a second guide groove 291*c* may be defined in an inner circumferential surface of the partition sleeve 291*a*. The first guide groove 291*b* may extend with a predetermined width and length in a longitudinal direction of the partition sleeve 291*a*, and the second guide groove 291*c* may extend in a band shape having a predetermined width and length in a circumferential direction of the partition sleeve 291*a*.

Here, the second guide groove 291*c* may communicate with the first guide groove 291*b*. Thus, the refrigerant guided to the second discharge chamber D2 moves backward in the axial direction along the first guide groove 1912*a* to move in the circumferential direction along the second guide groove 1912*b*.

Also, a communication groove 291*h* (see FIG. 16) having a depth from an end of the partition sleeve 291*a* to the second guide groove 291*c* may be defined to be stepped on the inner circumferential surface of the partition sleeve 291*a*. The communication groove 291*h* communicates with the second guide groove 291*c*.

The communication groove 291*h* may be understood as a passage through which the refrigerant moving in the circumferential direction along the second guide groove 291*c* flows into the third discharge chamber D3.

The communication groove 291*h* may be defined at a point spaced apart from the first guide groove 291*b* in the circumferential direction of the partition sleeve 291*a*. For example, the communication groove 291*h* may be defined in a position that is opposite to the first guide groove 291*b* or a position facing the first guide groove 291*b*. Thus, since a time for which the refrigerant flowing into the second guide groove 291*c* stays in the second guide groove 291*c* may increase, pulsation noise of the refrigerant may be effectively reduced.

In the drawings of the present specification, the first guide groove 291*b* is recessed in the inner circumferential surface of the partition sleeve 291*a* to extend to the end of the partition sleeve 291*a*. However, in fact, the refrigerant guided to the second discharge chamber D may be introduced into the second discharge chamber D2 through the first guide groove 291*b*. That is, when the discharge cover body 292 contacts the inside of the cover housing 291, an end of the first guide groove 291*b* may be covered by an outer surface of the discharge cover body 292.

However, the first guide groove 291*b* may inevitably extend to the end of the partition sleeve 291*a* due to the aluminum die casting process.

Also, the chamber part 291*e* may further include a pipe coupling part 291*n* to which the cover pipe 162 is coupled.

The pipe coupling part 291*n* may protrude from an outer circumferential surface of the chamber part 291*e*. A seating groove (not shown) is defined in the pipe coupling part 291*n* to mount the cover pipe 262 thereon.

Also, an insertion groove 291*p* through which an inlet end of the cover pipe 262 passes to be inserted is defined inside the seating groove. Here, the insertion groove 291*p* may communicate with the third discharge chamber D3.

Thus, when the cover pipe 262 is inserted into the insertion groove 291*p*, the refrigerant of the third discharge chamber D3 may be guided to the cover pipe 162. Also, the refrigerant guided to the cover pipe 262 may be discharged to the outside of the linear compressor 10 through the discharge pipe 205.

Also, the chamber part 291*e* may further include a recess part 291*r* avoiding an interference with the cover pipe 262 while the cover pipe 262 is coupled to the pipe coupling part 291*n*.

The recess part 291*r* functions to prevent the cover pipe 262 from contacting the front surface 291*m* of the chamber when the cover pipe 262 is inserted into the insertion groove 291*p*. For this, the recess part 291*r* may be defined by recessing backward from a portion of the front surface 291*m* of the chamber part. That is, the recess part 291*r* may be stepped from the front surface 291*m* of the chamber part.

The support device fixing part 291*d* extends from the front surface 291*m* of the chamber part in the axial direction of the shell 201. Particularly, the support device fixing part 291*d* may extend in a cylindrical shape having an outer diameter less than that of the chamber part 291*e* from the front surface 291*m* of the chamber part.

An end of each of the pair of first support devices 200 is coupled to an outer circumferential surface of the support device fixing part 191*d*. For this, a coupling groove 291*w* into which a coupling protrusion protruding from the front end of the first support device 200 is inserted is defined in the outer circumferential surface of the support device fixing part 291*d*.

Particularly, the coupling groove 291*w* has a pair of coupling groves 291*w* to which a side surface of the support device fixing part 291*d*, i.e., the surface (hereinafter, referred to as a circumferential surface) that has a cylindrical portion is coupled. The pair of coupling grooves 291*w* may be defined in positions spaced a predetermined angle from each other along the circumferential surface of the support device fixing part 291*d*. Also, the coupling groove 291*w* may be defined to pass from the circumferential surface of the support device fixing unit 291*d* toward a central portion of the support device fixing unit 291*d*. For example, the coupling groove 291*w* may have a circular cross-sectional shape, but is not limited thereto.

In FIG. 17, a length L2 in the horizontal direction in which the chamber part 291*e* extends forward may be greater than a length L3 in the horizontal direction in which the support device fixing part 291*d* extends forward. That is to say, the length L2 from the rear end to the front end of the chamber part 291*e* may be greater than the length L3 from the rear end to the front end of the support device fixing part 291*d*. Thus, the chamber 291*e* may secure a discharge space that is sufficient to sufficiently reduce the pulsation noise of the refrigerant.

Also, the length L1 from the rear end to the front end of the flange part 291*f* is less than the length L3 from the front end of the chamber part 291*e* to the front end of the support device fixing part 291*d*.

Also, a hook protrusion 291*g* on which the rear end of the discharge cover body 292 is hooked may be disposed to be stepped on the inner circumferential surface of the rear end of the chamber part 291*e*.

Referring to FIGS. 15 to 17, the discharge cover body 292 will be described in detail.

The discharge cover body 292 has a flange 292*e* having an outer edge on which the hook protrusion 291*g* is hooked, a seating part that is bent from an inner edge of the flange 292*e* to allow the valve spring assembly 240 to be seated, a cover body 292*d* extending from the front surface of the seating part 292*a*, and a bottle neck portion 292*f* extending from a central portion of the cover body 292*d* to an inner space of the cover body 292*d*. Here, the flange 292*e* of the discharge cover body 292 may be called a "cover flange".

In detail, the flange 292*e* is a member inserted into the hook protrusion 291*g* disposed on the housing cover 291. For example, the flange 292*e* may have an inner hollow circle or oval. The flange 292*e* is inserted inside the rear end of the chamber part 291*e*.

The seating part 292*a* has a second portion 292*c* that is bent forward from an inner edge of the flange 292*e* and a first portion 292*b* that is bent from a front end of the second portion 292*c* in a central direction of the discharge cover body 292. Also, the cover body 292*d* may be bent forward from the inner edge of the first portion 292*b* and then bent in the central direction of the discharge cover body 292.

In another aspect, a cross-sectional structure of the discharge cover 292 may be provided so that the bottle neck portion 292*f* extends from the front center of the cover body 292*d* to the inside of the discharge cover body 292, the first portion 292*b* extends from the rear end of the cover body 292*d* in the radial direction, the second portion 292*c* extend from the outer end of the first portion 292*b* in the axial direction, and the flange 292*e* extends from the rear end of the second portion 292*c* in the radial direction.

The inner space of the cover body 292*d* may be defined as the first discharge chamber D1, and a discharge hole 292*g* through which the refrigerant discharged from the first discharge chamber D1 passes may be defined in a rear end of the bottle neck portion 292*f*.

Here, the first discharge chamber D1 may be called an "accommodation part".

In detail, when the discharge cover body 292 is inserted into the cover housing 291, the front surface of the seating part 292*a* contacts an end portion of the partition sleeve 291*a*. Here, the second discharge chamber D2 may be covered when the front surface of the seating part 292*a* contacts an end of the partition sleeve 291*a*.

However, since the communication groove 291*h* defined in an end of the partition sleeve 291*a* is in a state of being spaced apart from the seating part 292*a*, the refrigerant guided to the second discharge chamber D2 may move to the third discharge chamber D3 through the communication groove 291*h*.

Also, the outer circumferential surface of the cover body 292*d* may be disposed to be spaced a predetermined interval from the first guide groove 291*b*. Thus, the refrigerant guided to the second discharge chamber D2 may be guided to the first guide groove 291*b* to flow into the second guide groove 292*c*.

Also, the front surface of the valve spring assembly 240 is seated on the first portion 292*b*, and the friction ring 243 contacts the second portion 292*c* to generate frictional force.

Also, a depth and/or width of the friction ring seating groove 241 is less than a diameter of the friction ring 243 so that an outer edge of the friction ring 243 protrudes from an outer circumferential surface of the spring support 241. Thus, when the valve spring assembly 240 is seated on the seating part 292*a*, the friction ring 243 is pressed by the second portion 292*c*, and thus, the circular cross-section may be deformed into an oval cross-section. As a result, the contact area with the second portion 292*c* may increase to generate a predetermined frictional force. Thus, a gap may not be defined between the second portion 292*c* and the outer circumferential surface of the spring support part 241, and a phenomenon in which the valve spring assembly 240 is idled in the circumferential direction may be prevented by the frictional force.

In addition, the spring support part 241 may not directly collide with the discharge cover body 292, specifically, the second portion 292*c* by the friction ring 243 to minimize the occurrence of striking noise.

Also, a gasket 210 may be interposed between the first portion 292*b* and the front surface of the spring support 241 to prevent the spring support 241 from directly colliding with the first portion 292*b*.

Also, the outer edge of the valve spring 242 is inserted into the spring support 241, the outer edge of the valve spring 242 may be disposed at a point closer to the rear than the front of the spring support 241. Also, a front central portion of the discharge valve 161 may be inserted into a center of the valve spring 242.

The refrigerant discharged from the compression space P by opening the discharge valve 261 passes through slits provided in the valve spring 241 and then is guided to the first discharge chamber D1. Here, the opening of the discharge valve 261 means that the discharge valve 261 moves in a direction closer to the rear end of the bottle neck portion 292*f* due to the elastic deformation of the valve spring 241 to open the front surface of the compression space P.

The refrigerant guided to the first discharge chamber D1 is guided to the second discharge chamber D2 through discharge holes 292*g* defined in a rear end of the bottle neck portion 292*f*. Here, when compared with the structure in which the discharge hole is defined in the front surface of the cover body 292*d*, the pulsation noise of the refrigerant may be significantly reduced by being defined in the bottle neck portion 292*f*. That is, after the refrigerant in the first discharge chamber D1 passes through the bottle neck portion 292*f* having a narrow cross-sectional area, the refrigerant is discharged to the second discharge chamber D2 having a wide cross-sectional area to significantly reduce noise due to the pulsation of the refrigerant.

Also, the refrigerant guided to the second discharge chamber D2 moves in the axial direction along the first guide groove 1912*a* to move in the circumferential direction along the second guide groove 1912*b*. Also, the refrigerant moving in the circumferential direction along the second guide groove 2912*c* passes through the third guide groove 291*h* and is guided to the third discharge chamber D3.

Here, in the process of discharging the refrigerant flowing along the first guide groove 291*b*, the second guide groove 291*c*, each of which has the narrow cross-sectional area, and the communication groove 291*h* into the third discharge chamber D3 having the large cross-sectional area, the pulsation noise of the refrigerant may be reduced once more.

The refrigerant guided into the third discharge chamber D3 is discharged to the outside of the compressor through the cover pipe 262.

Figure 18:
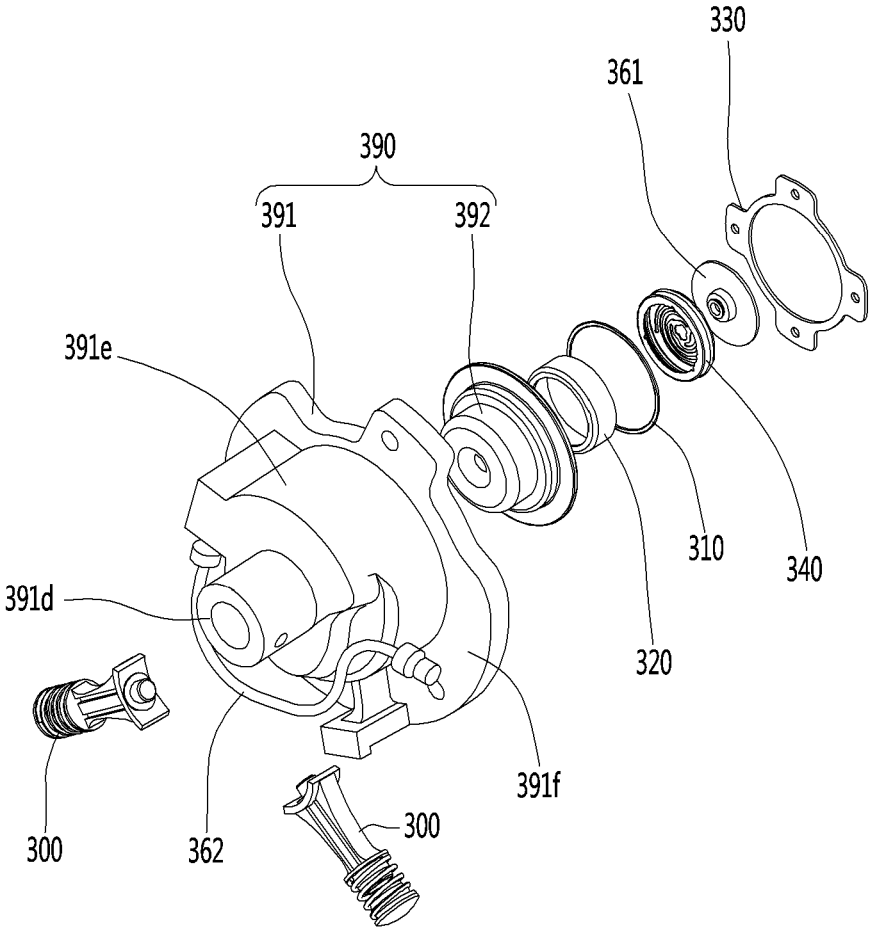
FIG. 18 is a partial exploded view illustrating a compressor body of a linear compressor according to a third embodiment.
Figure 19:
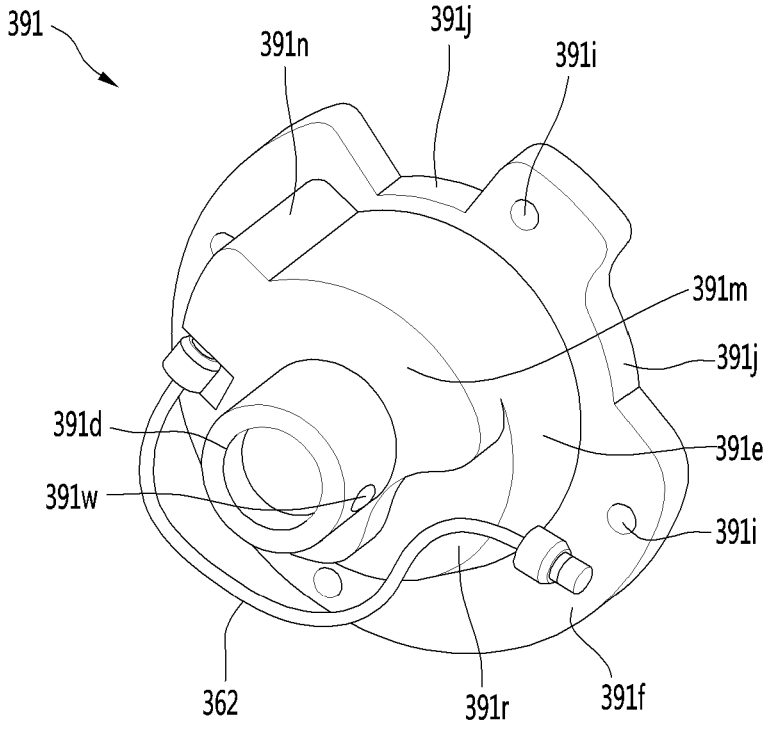
FIG. 19 is a view illustrating a cover housing of the linear compressor according to the third embodiment.

FIG. 18 is a partial exploded view illustrating a compressor body of a linear compressor according to a third embodiment, and FIG. 19 is a view illustrating a cover housing of the linear compressor according to the third embodiment.

As illustrated in FIGS. 18 and 19, a linear compressor 30 according to the third embodiment includes a discharge cover 390 and a first support device 300. Also, the discharge cover 390 includes a cover housing 391, a discharge cover body 392, and a fixing ring 320. Also, an insulation gasket 330 may be disposed between the cover housing 391 and a frame 110.

The cover housing 391 includes a flange part 391*f*, a chamber part 391*e*, and a support device fixing part 391*d*. Also, the linear compressor 30 may include a cover pipe 362, a discharge valve 361, a spring assembly 340, and a gasket 310.

The linear compressor according to the third embodiment has some differences in comparison to the shapes of the linear compressor and the discharge cover 390 according to the second embodiment. Hereinafter, the difference will be described in detail, and the rest of the descriptions are cited in the description of the second embodiment, and the duplicated descriptions will be omitted.

The flange part 391*f* is tightly fixed to a front surface of the frame. Particularly, the flange part 391*f* is bent from a rear end of the chamber part 391*e* to contact the front surface of the frame. That is, the flange part 391*f* may extend outward from the rear end of the chamber part 391*e*.

In another aspect, the flange part 391*f* may have a disk shape having a through-hole defined in a center thereof. The through-hole may have a circular shape.

Also, a coupling hole 391*i* may be defined in, the flange part 391*f* so to be coupled to the frame by a coupling member.

The coupling holes 391*i* may be provided in plurality that are spaced apart from each other. Here, the coupling holes 391*i* may be provided in three and may be spaced apart from each other at equal intervals in a circumferential direction of the flange part 391*f*. That is, since the flange part 391*f* is supported by the Frame at four points, the cover housing 391 may be strongly fixed to the front surface of the frame 110.

Such four-point support may increase in coupling force more than that of the linear compressor, which has the three-point support structure, according to the second embodiment. Thus, the frame 110 and the discharge cover 390 are more closely coupled to each other, and reduction of noise and vibration by the first support device 300 may further increase.

In summary, the first to third embodiments all include the discharge covers having the different shapes. Also, the first to third embodiments include the first support devices having the shapes similar to each other. In detail, the first support devices according to the second and third embodiments are identical to each other and correspond to the damping units of the first support device according to the first embodiment.

Hereinafter, the fourth to sixth embodiments include the same discharge cover as the first to third embodiments, but include first support devices having different shapes. This will be described in detail later.

Figure 20:
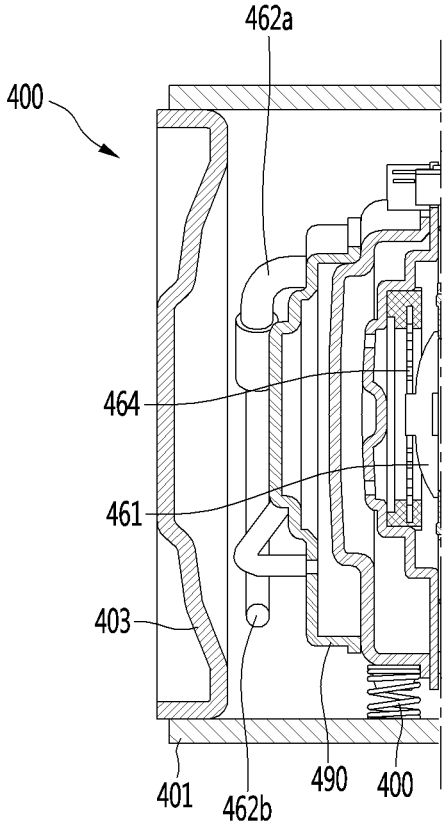
FIG. 20 is a view illustrating a portion of a cut cross-section of a linear compressor according to a fourth embodiment.

FIG. 20 is a view illustrating a portion of a cut cross-section of a linear compressor according to a fourth embodiment.

As illustrated in FIG. 20, a linear compressor 40 according to the fourth embodiment corresponds to the linear compressor 10 according to the first embodiment. That is, the linear compressor 40 includes a discharge cover 490 having a shape corresponding to that of the discharge cover 190 of the linear compressor 10 according to the first embodiment.

The discharge cover 490 may be provided in a form in which a plurality of covers are laminated. However, in the discharge cover 490, a coupling hole or a coupling groove may be omitted in a center of the discharge cover coupled to the outermost (or frontmost) of the plurality of covers.

The linear compressor 40 includes a first support device 400 disposed radially outside the discharge space D defined by the discharge cover 490. That is, the first support device 400 is disposed at a side of the discharge cover 490, not a front side.

Thus, in comparison to the first embodiment, a space in which the first support device 100 is disposed may be omitted. That is, a second shell cover 403 may be disposed to substantially contact the front side of the discharge cover 490. Here, a buffer member or the like may be provided between the second shell cover 403 and the discharge cover 490 to prevent collision from occurring.

Thus, an axial length of the shell 401 may more decrease, and a volume of the compressor 40 may decrease overall. Also, installability of the compressor 40 increases.

The first support device 400 may be provided as a member having an elastic force. For example, the first support device 400 may be provided in a form similar to the damping unit of the first support device according to the first embodiment.

Here, the first support device 400 has a length less than that of the damping unit of the first support device according to the first embodiment. This is because a distance between a side surface of the discharge cover 490 and the shell 401 is relatively narrow. Thus, the first support device 400 may not receive a large moment and thus may more stably support the discharge cover 490.

Figure 21:
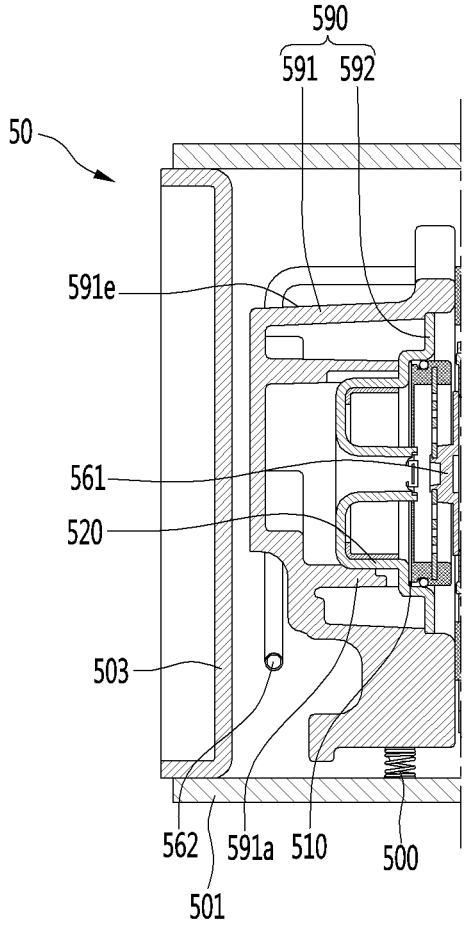
FIG. 21 is a view illustrating a portion of a cut cross-section of a linear compressor according to a fifth embodiment.
Figure 22:
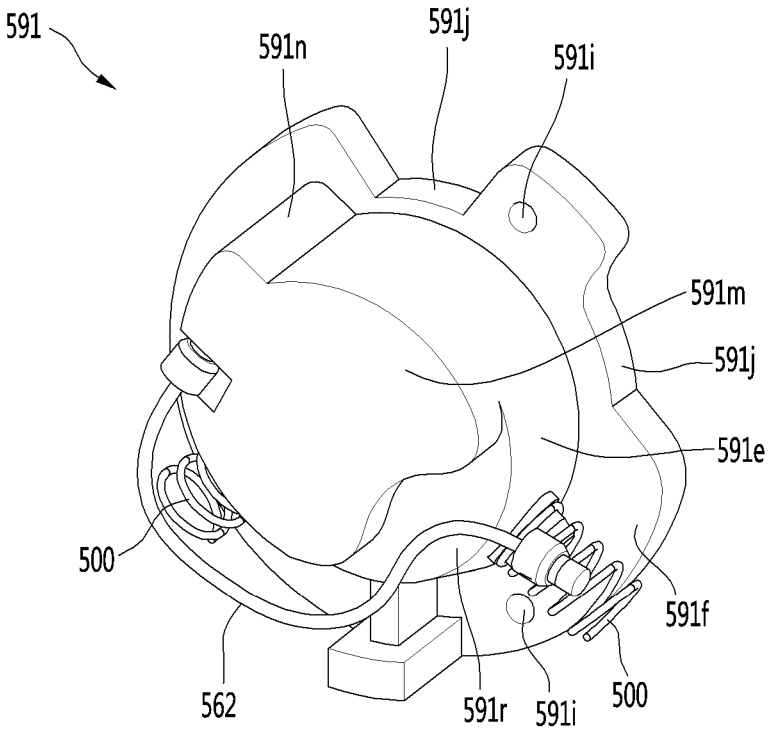
FIG. 22 is a view of a discharge cover and a first support device of the linear compressor according to a fifth embodiment.

FIG. 21 is a view illustrating a portion of a cut cross-section of a linear compressor according to a fifth embodiment, and FIG. 22 is a view of a discharge cover and a first support device of the linear compressor according to a fifth embodiment.

As illustrated in FIGS. 21, and 22, a linear compressor 50 according to the fifth embodiment corresponds to the linear compressor 20 according to the second embodiment. That is, the linear compressor 50 includes a discharge cover 590 having a shape corresponding to that of the discharge cover 290 of the linear compressor 20 according to the second embodiment.

The discharge cover 590 includes a cover housing 591, a discharge cover body 592, and a fixing ring 520. Also, an insulation gasket 530 may be disposed between the cover housing 591 and the frame 110.

The cover housing 591 includes a flange part 591*f* and a chamber part 591*e*. Here, unlike the discharge cover 290 according to the second embodiment, the support device fixing part is omitted in the discharge cover 590 according to the fifth embodiment. That is, a front surface 591*m* of the flange part 591*f* is disposed at the foremost in the axial direction.

The linear compressor 50 includes a first support device 500 disposed radially outside the discharge space D defined by the discharge cover 590. In detail, the first support device 500 may be coupled to the flange part 591*f* of the discharge cover 590 to extend to a shell 501.

Thus, when compared to the second embodiment, a space in which the support device fixing part is disposed may be omitted. That is, a second shell cover 503 may be disposed to substantially contact the front surface 591*m* of the flange part 591*f*. Here, a buffer member or the like may be provided between the second shell cover 503 and the discharge cover 590 to prevent collision from occurring.

Thus, an axial length of the shell 501 may more decrease, and a volume of the compressor 50 may decrease overall. Also, installability of the compressor 50 increases.

The first support device 500 may be provided as a member having an elastic force. For example, the first support device 500 may be provided in a form similar to the first support device according to the second embodiment.

Here, the first support device 500 has a length less than that of the first support device according to the second embodiment. This is because the flange part 591*f* has a relatively large diameter. Thus, the first support device 500 may not receive a large moment and thus may more stably support the discharge cover 590.

Figure 23:
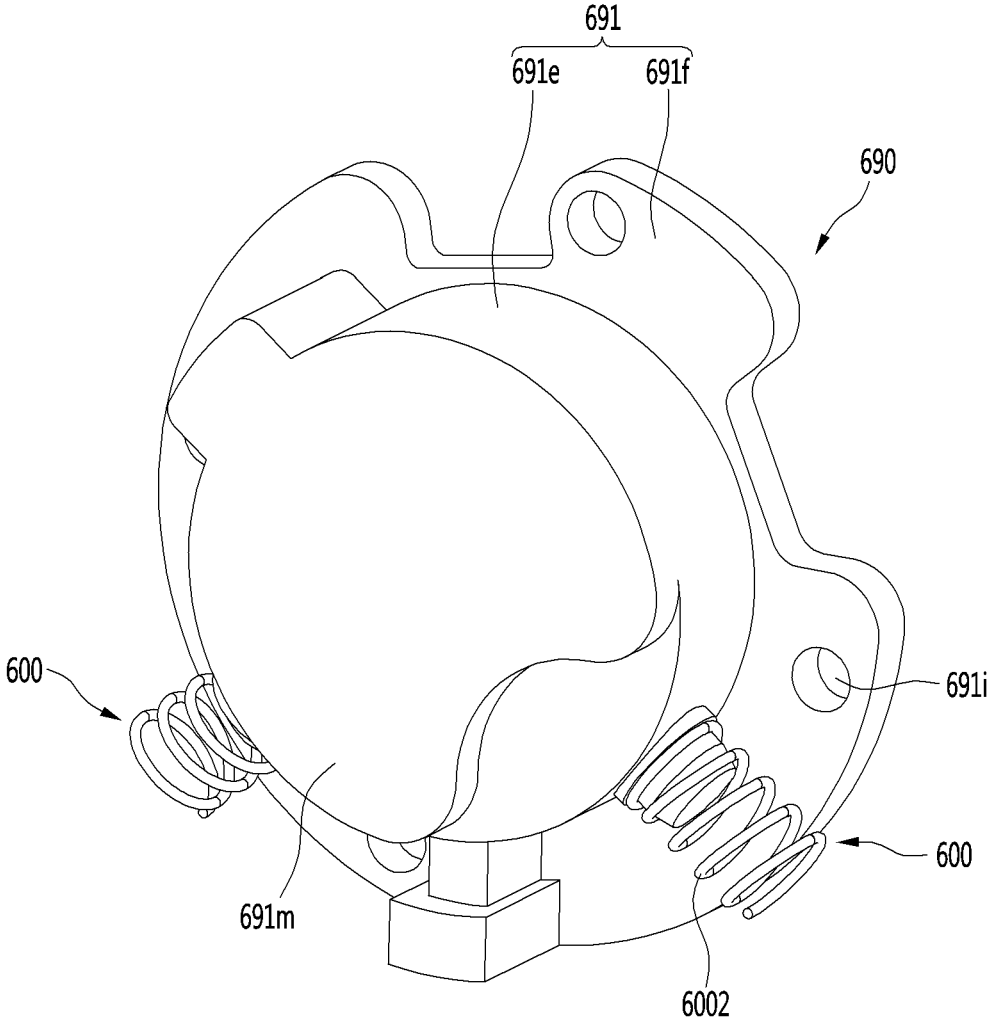
FIGS. 23 and 24 are views illustrating a discharge cover and a first support device of a linear compressor according to a sixth embodiment.
Figure 24:
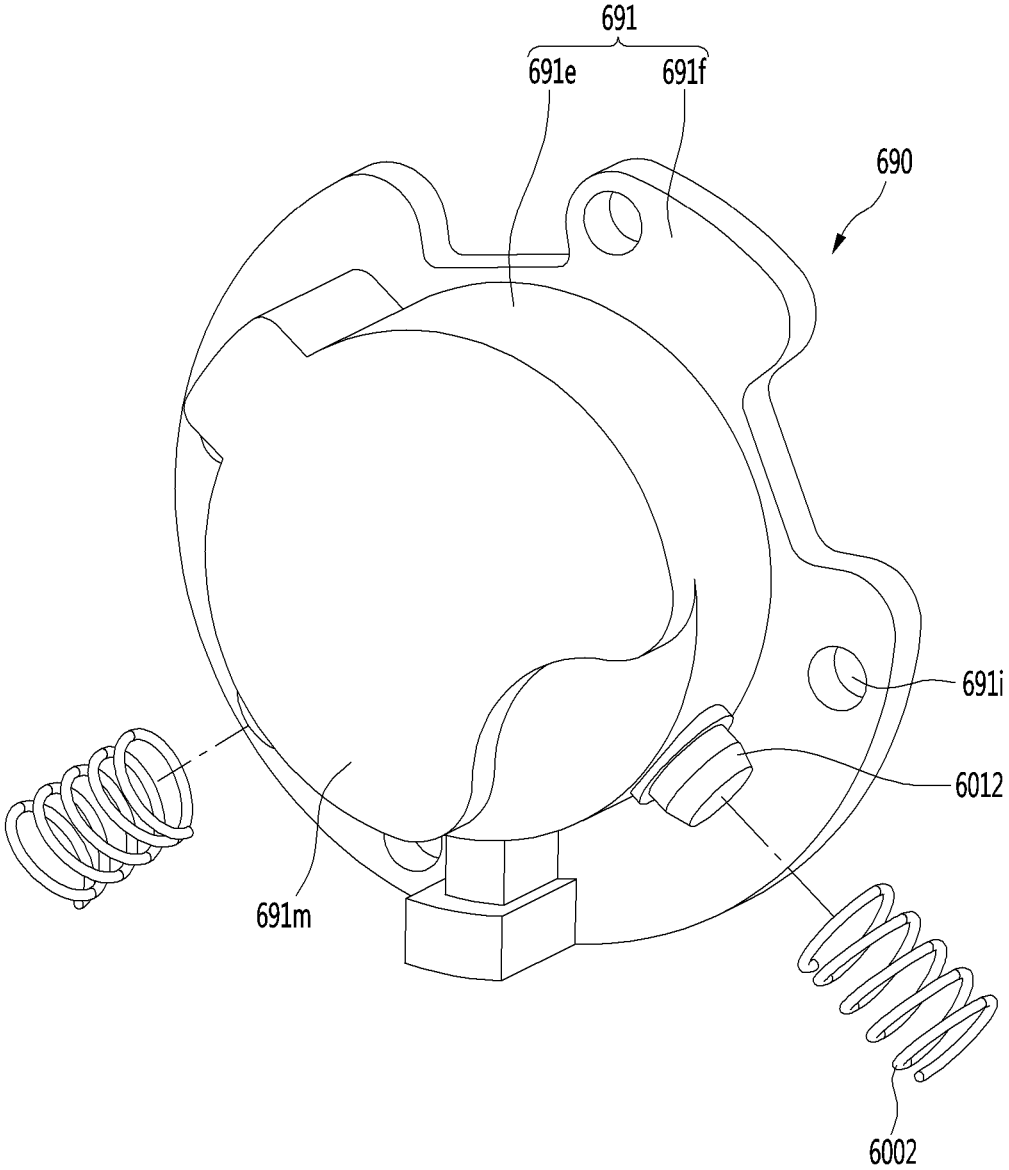

FIGS. 23 and 24 are views illustrating a discharge cover and a first support device of a linear compressor according to a sixth embodiment.

As illustrated in FIGS. 23, and 24, a linear compressor 60 according to the sixth embodiment corresponds to the linear compressor 30 according to the third embodiment. That is, the linear compressor 60 includes a discharge cover 690 having a shape similar to that of the discharge cover 390 of the linear compressor 30 according to the third embodiment.

The discharge cover 690 includes a cover housing 691. The cover housing 691 includes a flange part 691*f* and a chamber part 691*e*. Also, a coupling hole 691*i* may be defined in the flange part 691*f* so to be coupled to the frame by a coupling member.

The coupling holes 691*i* may be provided in four and may be spaced apart from each other at equal intervals in a circumferential direction of the flange part 691*f*. That is, since the flange part 691*f* is supported by the Frame at four points, the cover housing 691 may be strongly fixed to the front surface of the frame 110.

Here, unlike the discharge cover 390 according to the third embodiment, the support device fixing part is omitted in the discharge cover 690 according to the sixth embodiment. That is, a front surface 691*m* of the flange part 691*f* is disposed at the foremost in the axial direction.

The linear compressor 60 includes a first support device 600 disposed radially outside the discharge space D defined by the discharge cover 690. In detail, the first support device 600 may be coupled to the flange part 691*f* of the discharge cover 690 to extend to a shell.

Thus, when compared to the third embodiment, a space in which the support device fixing part is disposed may be omitted. That is, a third shell cover may be disposed to substantially contact the front surface 691*m* of the flange part 691*f*. Here, a buffer member or the like may be provided between the second shell cover and the discharge cover 690 to prevent collision from occurring.

Thus, an axial length of the shell may more decrease, and a volume of the compressor 60 may decrease overall. Also, installability of the compressor 60 increases.

Here, the first support device 600 has a length less than that of the first support device according to the third embodiment. This is because the flange part 691*f* has a relatively large diameter. Thus, the first support device 600 may not receive a large moment and thus may more stably support the discharge cover 690.

In detail, the first support device 600 includes an elastic fixing part 6012 fixed to the chamber part 691*e* and an elastic member 6002 having one end inserted into the elastic fixing part 6012. The elastic member 6002 includes a coil spring and may be installed to be tensioned and compressed in a radial direction.

Also, an inner circumferential surface of the shell may be provided with a fixing part into which the elastic member 6002 is inserted. The fixing part may be provided to protrude from an inner circumferential surface of the shell in the same shape as the elastic fixing part 6012. Thus, both ends of the elastic member 6002 may be fixed to the shell and the discharge cover 191 so as to be tensioned and compressed.

Also, a groove into which the other end of the elastic member 6002 is inserted may be defined in the inner circumferential surface of the shell. Therefore, the elastic member 6002 may be fixed by installing the elastic member 6002 in the shell in the state in which the elastic member 6002 is coupled to the discharge cover 191.

According to the embodiment, the support body (first support device) may be disposed between the compressor body and the shell in the radial direction to stably support the compressor body in the radial direction.

Also, since the first support device may not be disposed between the compressor body and the shell in the axial direction, the unnecessary space may be omitted.

Thus, the size of the shell may be reduced, and the overall volume of the linear compressor may be reduced. Furthermore, the freedom of installation of the linear compressor may increase.

Also, the first support device may contact the shell without the separate coupling member to significantly reduce the failure rate of assembly due to the coupling member such as the bolts.

Also, as the compressor body is spaced apart from the shell and supported, the noise and vibration generated during the reciprocating movement of the piston and the compression of the refrigerant may be prevented from being transmitted to the shell.

Thus, the shell may prevent the noise and vibration from being transmitted to the outside of the linear compressor. Also, the noise and vibration may be reduced in the space in which the linear compressor is installed to achieve the user's convenience.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell having a cylindrical shape that extends in an axial direction;

a compressor body disposed within the shell;

a first shell cover coupled to a first end of the shell;

a second shell cover coupled to a second end of the shell and spaced apart from the first shell cover in the axial direction;

a first support device coupled to a front portion of the compressor body that faces the second shell cover, the first support device being configured to support the compressor body; and a second support device disposed between the compressor body and the first shell cover and configured to support the compressor body in the axial direction, wherein the first support device is disposed between an inner circumferential surface of the shell and the compressor body and configured to support the compressor body in a radial direction of the shell, wherein the compressor body comprises:

a cylinder that defines a compression space configured to accommodate refrigerant compressed therein, a discharge cover that defines a discharge space configured to receive the refrigerant discharged from the compression space, and a frame coupled to the discharge cover, wherein the discharge cover comprises:

a flange part coupled to a front surface of the frame that faces the second shell cover, and a chamber part that extends from the flange part toward the second shell cover in the axial direction and that defines the discharge space therein, and wherein the first support device radially faces a side surface of the chamber part surrounding the discharge space, the first support device having a first end coupled to the side surface of the chamber part and a second end coupled to the inner circumferential surface of the shell.

2. The linear compressor according to claim 1, wherein the compressor body and the second shell cover are disposed adjacent to each other in the axial direction, and wherein a front surface of the chamber part faces the second shell cover and defines a frontmost portion of the compressor body in the axial direction.

3. The linear compressor according to claim 1, wherein the flange part defines a plurality of coupling holes, each of the plurality of coupling holes receiving a coupling member that couples to the frame, and wherein the plurality of coupling holes are spaced apart from one another by a same interval and arranged along a circumferential direction of the flange part, the flange part being supported by a plurality of points of the frame.

4. The linear compressor according to claim 1, wherein the first support device comprises:

an elastic fixing part that is fixed to the chamber part; and an elastic member having a first end that receives the elastic fixing part, the elastic member comprising a coil spring configured to be stretched and compressed in the radial direction.

5. The linear compressor according to claim 4, wherein the shell comprises a fixing part disposed on the inner circumferential surface of the shell and inserted into a second end of the elastic member, and wherein the elastic member is configured to be stretched and compressed in a state in which the first end and the second end are fixed to the discharge cover and the shell, respectively.

6. The linear compressor according to claim 4, wherein the shell defines a groove that receives a second end of the elastic member and that is disposed at the inner circumferential surface of the shell.

7. The linear compressor according to claim 1, wherein the discharge cover comprises a partition sleeve that partitions the discharge space into an inner space and an outer space defined outward relative to the inner space in the radial direction.

8. The linear compressor according to claim 1, wherein the compressor body comprises a discharge cover disposed at a frontmost portion of the compressor body facing the second shell cover, the discharge cover comprising a plurality of covers that are laminated, and wherein the first support device is disposed between the inner circumferential surface of the shell and an outermost cover among the plurality of covers.

9. The linear compressor according to claim 1, wherein the first support device comprise a pair of first support devices that are spaced apart from each other by a predetermined angle and arranged along a circumferential direction of the compressor body, each of the pair of first support devices connecting the inner circumferential surface of the shell to the compressor body.

10. The linear compressor according to claim 1, wherein the side surface of the chamber part is an outer circumferential surface of the chamber part that is in direct contact with the first end of the first support device.

11. The linear compressor according to claim 10, wherein the second end of the first support device is in direct contact with the inner circumferential surface of the shell.

12. The linear compressor according to claim 1, wherein the discharge space extends further toward the second shell cover relative to the first support device.

13. A linear compressor comprising:

a cylinder that extends in an axial direction, the cylinder defining a compression space configured to accommodate refrigerant compressed therein;

a piston accommodated in the cylinder and configured to reciprocate relative to the cylinder;

a frame that accommodates the cylinder therein;

a discharge cover that is coupled to the frame and that defines a discharge space configured to receive the refrigerant discharged from the compression space;

a shell that accommodates the cylinder, the frame, and the discharge cover therein; and a support device disposed radially between the discharge cover and the shell, wherein the discharge cover comprises a cover housing that is fixed to a first surface of the frame, the cover housing comprising:

a flange part coupled to the first surface of the frame, and a chamber part that extends from the flange part away from the cylinder in the axial direction and that defines the discharge space, and wherein the support device radially faces a side surface of the chamber part surrounding the discharge space, the support device having a first end coupled to the side surface of the chamber part and a second end coupled to an inner circumferential surface of the shell.

14. The linear compressor according to claim 13, wherein the flange part defines a plurality of coupling holes, each of the plurality of coupling holes receiving a coupling member that couples to the frame, and wherein the plurality of coupling holes are spaced apart from one another by a same interval and arranged along a circumferential direction of the flange part, the flange part being supported by a plurality of points of the frame.

15. The linear compressor according to claim 13, wherein the support device comprises:

an elastic fixing part that is fixed to the chamber part; and an elastic member having a first end that receives the elastic fixing part, the elastic member comprising a coil spring configured to be stretched and compressed in a radial direction of the cylinder.

16. The linear compressor according to claim 13, wherein the support device comprises a pair of first support devices that are spaced apart from each other by a predetermined angle and that are arranged along a circumferential direction of the chamber part, each of the pair of first support devices connecting the inner circumferential surface of the shell to the chamber part.

* * * * *